US009763493B2

(12) United States Patent
Nishiwaki et al.

(10) Patent No.: US 9,763,493 B2
(45) Date of Patent: Sep. 19, 2017

(54) MID SOLE HAVING LAYERED STRUCTURE

(71) Applicants: Tsuyoshi Nishiwaki, Kobe (JP); Masashi Isobe, Kobe (JP)

(72) Inventors: Tsuyoshi Nishiwaki, Kobe (JP); Masashi Isobe, Kobe (JP)

(73) Assignee: ASICS CORPORATION (JP)

( * ) Notice: Subject to any disclaimer, the term of this patent is extended or adjusted under 35 U.S.C. 154(b) by 19 days.

(21) Appl. No.: 14/774,610

(22) PCT Filed: Mar. 15, 2013

(86) PCT No.: PCT/JP2013/057398
§ 371 (c)(1),
(2) Date: Sep. 10, 2015

(87) PCT Pub. No.: WO2014/141467
PCT Pub. Date: Sep. 18, 2014

(65) Prior Publication Data

US 2016/0015122 A1 Jan. 21, 2016

(51) Int. Cl.
*A43B 13/12* (2006.01)
*A43B 13/16* (2006.01)
(Continued)

(52) U.S. Cl.
CPC ..... *A43B 13/127* (2013.01); *A43B 13/04* (2013.01); *A43B 13/122* (2013.01);
(Continued)

(58) Field of Classification Search
CPC ... A43B 13/125; A43B 13/127; A43B 13/187; A43B 13/04
See application file for complete search history.

(56) References Cited

U.S. PATENT DOCUMENTS 4,399,620 A * 8/1983 Funck ..... A43B 7/28 36/28
5,014,449 A * 5/1991 Richard ..... A43B 3/0084 36/114
(Continued)

FOREIGN PATENT DOCUMENTS

JP S58190401 A 11/1983
JP H0569521 A 3/1993
(Continued)

OTHER PUBLICATIONS

English Translation of International Search Report issued in PCT/JP2013/057398 on Apr. 16, 2013.
(Continued)

*Primary Examiner* — Ted Kavanaugh
(74) *Attorney, Agent, or Firm* — Katten Muchin Rosenman LLP

(57) ABSTRACT

A mid sole arranged on an outsole having a tread surface, the mid sole including: an upper layer and a lower layer, wherein one of the upper layer and the lower layer includes a layer of a first foamed body having a thermoplastic resin component; in another one of the upper layer and the lower layer, one or two or more of a majority of a flat area of a front foot portion, a majority of a flat area of a middle foot portion, and a majority of a flat area of a rear foot portion includes a layer of a second foamed body having a thermoplastic resin component; and the second foamed body has a greater specific gravity than the first foamed body, and is formed by a low-resilience material having a low speed of recovering to its original shape after being deformed.

24 Claims, 14 Drawing Sheets

(51) Int. Cl.

| | |
|---|---|
| ***A43B 13/18*** | (2006.01) |
| ***A43B 13/04*** | (2006.01) |
| ***A43B 13/22*** | (2006.01) |
| ***A43B 13/42*** | (2006.01) |

(52) U.S. Cl.
CPC ..... *A43B 13/125* (2013.01); *A43B 13/16* (2013.01); *A43B 13/187* (2013.01); *A43B 13/223* (2013.01); *A43B 13/42* (2013.01)

(56) References Cited

U.S. PATENT DOCUMENTS

| | | | | |
|---|---|---|---|---|
| 5,155,927 | A | 10/1992 | Bates et al. | |
| 5,493,792 | A | 2/1996 | Bates et al. | |
| 5,718,063 | A | 2/1998 | Yamashita et al. | |
| D416,381 | S | 11/1999 | Senda et al. | |
| 6,199,302 | B1 | 3/2001 | Kayano | |
| 6,212,795 | B1 | 4/2001 | Nakabe et al. | |
| 6,438,870 | B2 | 8/2002 | Nasako et al. | |
| 6,467,191 | B2 | 10/2002 | Hayashi et al. | |
| 6,685,011 | B2 | 2/2004 | Nishiwaki et al. | |
| D495,859 | S | 9/2004 | Kubo et al. | |
| D496,148 | S | 9/2004 | Kayano et al. | |
| 6,789,333 | B2 | 9/2004 | Nishiwaki et al. | |
| D501,713 | S | 2/2005 | Kayano et al. | |
| D509,351 | S | 9/2005 | Kayano et al. | |
| D512,208 | S | 12/2005 | Kubo et al. | |
| D512,818 | S | 12/2005 | Mitani et al. | |
| D512,819 | S | 12/2005 | Usuki et al. | |
| D512,827 | S | 12/2005 | Usuki et al. | |
| D512,828 | S | 12/2005 | Kubo et al. | |
| D513,115 | S | 12/2005 | Kayano et al. | |
| D514,286 | S | 2/2006 | Kayano et al. | |
| D520,732 | S | 5/2006 | Mitani et al. | |
| D542,522 | S | 5/2007 | Fujita et al. | |
| D552,833 | S | 10/2007 | Yamashita et al. | |
| D553,846 | S | 10/2007 | Kayano et al. | |
| 7,322,131 | B2 | 1/2008 | Yamashita et al. | |
| D561,434 | S | 2/2008 | Fujita et al. | |
| D561,442 | S | 2/2008 | Kayano et al. | |
| 7,325,323 | B2 | 2/2008 | Katsu et al. | |
| D571,086 | S | 6/2008 | Yamashita et al. | |
| D571,090 | S | 6/2008 | Fujita et al. | |
| D575,486 | S | 8/2008 | Yamashita et al. | |
| D582,658 | S | 12/2008 | Fujita et al. | |
| D614,855 | S | 5/2010 | Inohara et al. | |
| 7,779,558 | B2 | 8/2010 | Nishiwaki et al. | |
| 7,877,899 | B2 | 2/2011 | Nishiwaki et al. | |
| 7,987,618 | B2 | 8/2011 | Nishiwaki et al. | |
| 8,008,363 | B2 | 8/2011 | Mori et al. | |
| D650,566 | S | 12/2011 | Yamashita et al. | |
| 8,074,377 | B2 | 12/2011 | Nishiwaki et al. | |
| 8,112,909 | B2 | 2/2012 | Kubo et al. | |
| 8,418,379 | B2 | 4/2013 | Nishiwaki et al. | |
| 8,453,344 | B2 | 6/2013 | Nishiwaki et al. | |
| 8,461,222 | B2 | 6/2013 | Mori et al. | |
| 8,544,190 | B2 | 10/2013 | Nishiwaki et al. | |
| D734,927 | S | 7/2015 | Ando et al. | |
| D734,928 | S | 7/2015 | Ando et al. | |
| 9,089,185 | B2 | 7/2015 | Nishiwaki et al. | |
| 2008/0244926 | A1 | 10/2008 | Yu et al. | |
| 2010/0186264 | A1 | 7/2010 | Cook et al. | |
| 2010/0293816 | A1* | 11/2010 | Truelsen | A43B 5/06 36/30 R |
| 2011/0061264 | A1* | 3/2011 | Solymosi | A43B 7/142 36/88 |
| 2011/0179669 | A1 | 7/2011 | Hanebrink et al. | |
| 2011/0197468 | A1 | 8/2011 | Kubo et al. | |
| 2012/0216422 | A1 | 8/2012 | Ikezawa et al. | |
| 2013/0008053 | A1 | 1/2013 | Nishiwaki et al. | |
| 2013/0055596 | A1 | 3/2013 | Wan et al. | |
| 2015/0082668 | A1 | 3/2015 | Nonogawa et al. | |
| 2015/0135558 | A1 | 5/2015 | Inomata et al. | |
| 2015/0143723 | A1* | 5/2015 | Tateishi | A43B 13/04 36/25 R |
| 2015/0181975 | A1 | 7/2015 | Otsuka et al. | |
| 2015/0250260 | A1 | 9/2015 | Bessho et al. | |
| 2016/0263851 | A1* | 9/2016 | Wan | A43B 1/0027 |

FOREIGN PATENT DOCUMENTS

| | | | |
|---|---|---|---|
| JP | H07125107 | | 5/1995 |
| JP | H08168402 | A | 7/1996 |
| JP | H11266905 | | 10/1999 |
| JP | 2003079402 | | 3/2003 |
| JP | 2008132008 | | 6/2008 |
| JP | 2009178594 | | 8/2009 |
| JP | 2009538191 | A | 11/2009 |
| JP | 2010094480 | | 4/2010 |
| JP | 2010525917 | A | 7/2010 |
| JP | 2011512184 | A | 4/2011 |
| JP | 2011177206 | | 9/2011 |
| WO | WO-2007/139832 | A2 | 12/2007 |

OTHER PUBLICATIONS

Supplementary European Search Report issued in European Patent Application No. EP 13877615.8-1655, dated Oct. 11, 2016 (Oct. 11, 2016).

* cited by examiner

FIG.5A
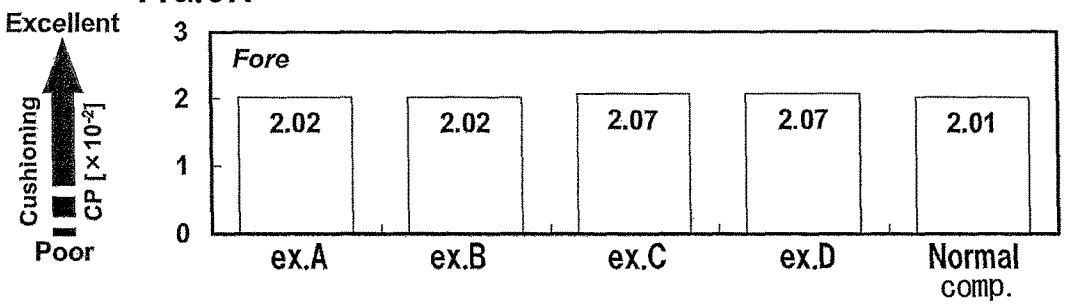
FIG.5B
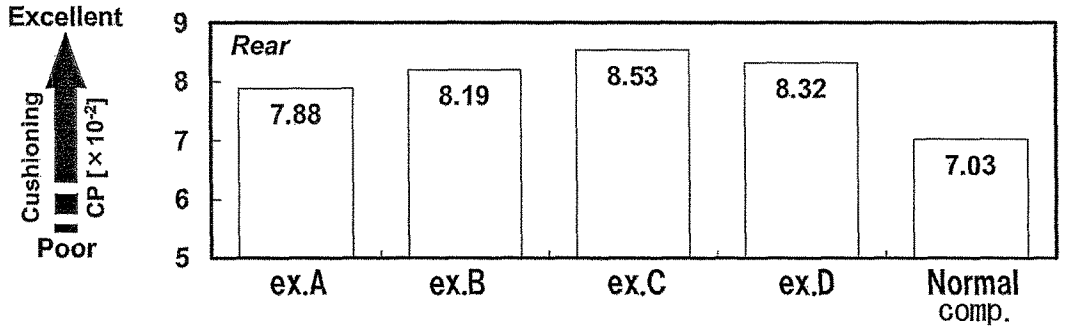
FIG.5C
| | ex.A | ex.B | ex.C | ex.D | Normal comp. |
|---|---|---|---|---|---|
| L.R.foam | 35° | 35° | 45° | 45° | - |
| Normal foam | 55° | 65° | 55° | 65° | 53° |

FIG.6B : Mid

FIG.9B : Case1

2 :L.R.foam

3 :Normal foam

| | 35 | 40 | 45 | 50 | 55 | 60 |
|---|---|---|---|---|---|---|
| 50 | × | × | × | ○ | ◎ | ○ |
| 55 | × | ○ | ◎ | ◎ | ◎ | ◎ |
| 60 | × | × | × | × | × | × |
| 65 | × | × | × | × | × | × |

| Position | Evaluation |
|---|---|
| - 5.7 | × |
| 5.7 - 5.72 | ○ |
| 5.72 - 5.8 | ◎ |
| 5.8 - 5.82 | ○ |
| 5.82 - 5.9 | △ |
| 5.9 - | × |

Case11,12,14,15

Case13

Case21,22,24,25

Case23

2:L.R.foam

3:Normal foam

| | 35 | 40 | 45 | 50 | 55 | 60 |
|---|---|---|---|---|---|---|
| 50 | ◎ | ○ | × | × | × | × |
| 55 | △ | ○ | ◎ | ◎ | ◎ | ○ |
| 60 | △ | ○ | ◎ | ○ | × | × |
| 65 | △ | △ | ◎ | ◎ | × | × |

3:L.R.foam

2:Normal foam

| | 35 | 40 | 45 | 50 | 55 | 60 |
|---|---|---|---|---|---|---|
| 50 | × | × | × | × | ○ | ◎ |
| 55 | × | × | × | × | × | ○ |
| 60 | × | × | × | × | × | × |
| 65 | × | × | × | × | × | × |

3:L.R.foam

2:Normal foam

| | 35 | 40 | 45 | 50 | 55 | 60 |
|---|---|---|---|---|---|---|
| 50 | × | × | × | × | × | × |
| 55 | × | × | × | × | × | × |
| 60 | × | × | × | × | × | × |
| 65 | × | × | × | × | × | × |

2:L.R.foam

3:Normal foam

| | 35 | 40 | 45 | 50 | 55 | 60 |
|---|---|---|---|---|---|---|
| 50 | ◎ | × | × | × | × | × |
| 55 | × | △ | ◎ | × | × | × |
| 60 | × | × | △ | ◎ | × | × |
| 65 | × | × | × | × | ◎ | ○ |

3:L.R.foam

2:Normal foam

| | 35 | 40 | 45 | 50 | 55 | 60 |
|---|---|---|---|---|---|---|
| 50 | × | × | × | ◎ | △ | × |
| 55 | × | × | × | × | ◎ | × |
| 60 | × | × | × | × | × | × |
| 65 | × | × | × | × | × | × |

3:L.R.foam

2:Normal foam

| | 35 | 40 | 45 | 50 | 55 | 60 |
|---|---|---|---|---|---|---|
| 50 | ◎ | × | × | × | × | × |
| 55 | × | △ | ◎ | × | × | × |
| 60 | × | × | △ | ◎ | × | × |
| 65 | × | × | × | × | ◎ | ○ |

Case14

| 3:Normal foam | 2:Normal foam | | | | |
|---|---|---|---|---|---|
| | 35 | 40 | 45 | 50 | |
| 55 | | | △ | | |
| 60 | | | △ | | |
| 65 | | | × | | |

Case15

| 3:Normal foam | 2:Normal foam | | | | |
|---|---|---|---|---|---|
| | 35 | 40 | 45 | 50 | |
| 55 | | | × | | |
| 60 | | | × | | |
| 65 | | | × | | |

Case24

| 3:Normal foam | 2:Normal foam | | | | |
|---|---|---|---|---|---|
| | 35 | 40 | 45 | 50 | |
| 55 | | | × | | |
| 60 | | | × | | |
| 65 | | | × | | |

Case25

| 3:Normal foam | 2:Normal foam | | | | |
|---|---|---|---|---|---|
| | 35 | 40 | 45 | 50 | |
| 55 | | | × | | |
| 60 | | | × | | |
| 65 | | | × | | |

MID SOLE HAVING LAYERED STRUCTURE

RELATED APPLICATION

This patent application is a national stage application, filed under 35 U.S.C. §371, of International Application No. PCT/JP2013/057398 filed on Mar. 15, 2013, the contents of which are hereby fully incorporated by reference.

TECHNICAL FIELD

The present invention relates to a mid sole having a layered structure.

BACKGROUND ART

The front foot portion typically has a small thickness. On the other hand, the front foot portion is bent significant and repeatedly at the MP joint, or the like. In areas where this bending is repeated, the mid sole eventually undergoes permanent deformation. Particularly, the permanent deformation is likely to occur in the upper layer of the front foot portion.

The middle foot portion supports the arch of the foot. The arch has significant individual variations. Wearers having low arch are likely to feel an upthrust against the arch, whereas wearers having high arch may have their arch drop.

When a shoe lands on the ground, a largest impact load acts upon the foot sole via the sole therebetween on the lateral side of the rear foot portion. This is referred to as the 1st strike, and it is important to absorb the impact of the 1st strike.

A mid sole of a layered structure is likely to exert other functions as compared with a mid sole of a single-layer structure.

CITATION LIST

Patent Literature

First Patent Document: JP58-190401A (Drawings)
Second Patent Document: JP05-69521A (Column 13)
Third Patent Document: JP07-125107A (Abstract)
Fourth Patent Document: JP08-168402A (Abstract)
Fifth Patent Document: JP11-266905A (Abstract)
Sixth Patent Document: JP2003-79402A (Abstract)
Seventh Patent Document: JP2009-178594A (Abstract)
Eighth Patent Document: JP2010-525917W (Abstract)
Ninth Patent Document: JP2010-94480A (Abstract)

SUMMARY OF INVENTION

The mid sole is often formed by a foamed body having a high resiliency. The documents identified above use foamed bodies, or the like, having different hardnesses from one another. However, a mid sole has not been known in the art in which a foamed body used in typical mid soles and a foamed body having a lower resilience than the foamed body are layered together over a large area.

Therefore, it is an object of the present invention to improve the function of a mid sole by arranging a low-resilience foamed body over a large area.

In a first aspect, the mid sole of the present invention is:

a mid sole arranged on an outsole having a tread surface, the mid sole including: an upper layer and a lower layer, wherein one of the upper layer and the lower layer includes a layer of a first foamed body having a thermoplastic resin component;

in another one of the upper layer and the lower layer, one or two or more of a majority of a flat area of a front foot portion, a majority of a flat area of a middle foot portion, and a majority of a flat area of a rear foot portion includes a layer of a second foamed body having a thermoplastic resin component; and the second foamed body has a greater specific gravity than the first foamed body, and is formed by a low-resilience material having a speed of recovering to its original shape after being deformed lower than that of the first foamed body, wherein a relationship between an asker C hardness Lc of the second foamed body S and an asker C hardness Nc of the first foamed body N is set to satisfy Expression (1) below:

$$Lc \leq Nc+10 \quad (1).$$

In another aspect, the mid sole of the present invention is:

a mid sole arranged on an outsole having a tread surface, the mid sole including: an upper layer and a lower layer, wherein the lower layer includes a layer of a first foamed body having a thermoplastic resin component;

in the upper layer, one or two or more of a majority of a flat area of a front foot portion, a majority of a flat area of a middle foot portion, and a majority of a flat area of a rear foot portion includes a layer of a second foamed body having a thermoplastic resin component; and the second foamed body has a greater specific gravity than the first foamed body, and is formed by a low-resilience material having a speed of recovering to its original shape after being deformed lower than that of the first foamed body, wherein a relationship between an asker C hardness Lc of the second foamed body and an asker C hardness Nc of the first foamed body is set to satisfy Expression (1) below:

$$Lc \leq Nc+10 \quad (1).$$

With the low-resilience second foamed body having a large specific gravity, the distance between bubbles is greater than that in the first foamed body. Therefore, buckling is not likely to occur, and the increase in load and the increase in strain are likely to be in proportion to each other. That is, while the second foamed body has a large specific gravity, the linearity of deformation is high. Therefore, the second foamed body may be a foamed body having a relatively low hardness.

On the other hand, with the first foamed body having a small specific gravity, the distance between bubbles is smaller than that of the second foamed body. Therefore, it is believed that although it exhibits a linearity under a small load less than or equal to a predetermined load, buckling occurs in the resin structure when a load greater than or equal to a predetermined load is applied thereto. There is a stress area where the strain increases abruptly for a small load increase. That is, while the first foamed body has a small specific gravity, the non-linearity is high. Therefore, the first foamed body is preferably a foamed body having a relatively high hardness.

Now, a layered structure including these foamed bodies layered on top of one another will have a mechanical (physical) property close to what is obtained by combining the mechanical (physical) properties of them. Therefore, the range of load over which linearity is exhibited for the layered structure is larger than that for the first foamed body, and the weight thereof will not increase so much.

Thus, by appropriately setting the hardness and the thickness of the upper and lower layers, it may be possible to realize a new level of shock-absorbing property (cushioning property) and stability that has not been obtained in the art.

A low-resilience second foamed body has a low speed of recovering to its original shape after being deformed, and therefore it typically has a low speed of deformation when an external force is applied. Therefore, it is possible to easily absorb energy and one can expect an improvement to the cushioning property.

On the other hand, even where the load is high, for a dynamic load of which the load is applied over a short period of time, such as running or walking, the low-resilience second foamed body is unlikely to undergo such a significant deformation due to a delay in deformation, and one can expect an improvement to the stability.

Particularly, by layering together with the first foamed body, it is possible to prevent the low-resilience second foamed body from being too thick, and it is possible to prevent an excessive deformation of the low-resilience second foamed body. Therefore, one can expect both an improvement to the cushioning property and an improvement to the stability.

One can expect such advantageous effects as described above, whether the first foamed body or the second foamed body is arranged on top of the other.

For example, where the hardness of the second foamed body is lower than that of the first foamed body, if the second foamed body, which deforms with a delay, is present immediately upon the outsole, the second foamed body undergoes significant shear deformation (slide) when a large frictional force in the horizontal direction locally acts on a portion of the outsole. Thus, if the second foamed body is too thick, there may occur a significant slide between the road surface and the first foamed body, thereby lowering the stability. In contrast, if the lower layer is the first foamed body, such a decrease of stability is unlikely to occur even if the second foamed body has a low hardness.

Therefore, in the second aspect described above, the stability is unlikely to lower, the thickness of the first foamed body can be made sufficiently large, and it is possible to further increase the cushioning property.

In the present invention, the relationship between the asker C hardness Lc of the second foamed body and the asker C hardness Nc of the first foamed body is set to satisfy Expression (1) below:

$$Lc \leq Nc + 10 \quad (1).$$

The reason for this setting is as follows. It is believed that if the asker C hardness Lc of the second foamed body, which is a low-resilience material, is greater than the asker C hardness Nc of the first foamed body N by 10° or more, the deformation of the low-resilience material will be too small, thus failing to sufficiently absorb the impact, or the hardness Nc of the first foamed body will be too small and the deformation of the first foamed body too large, thus lowering the stability or the shock-absorbing property.

Herein, in the present invention, the low-resilience material of the second foamed body is defined by the specific gravity and the recovering speed.

Typically, the low-resilience material is often defined by the storage elastic modulus Gω. However, it is difficult to cut a subject piece out of an actual product to measure the storage elastic modulus Gω.

On the other hand, the low-resilience material has a higher specific gravity and a lower recovering speed as compared with the foamed body of a typical mid sole. These physical quantities are much easier to measure than the storage elastic modulus Gω.

In view of this, in the present invention, the low-resilience material is defined by the specific gravity and the recovering speed.

The storage elastic modulus Gω of an unfoamed formation material of a low-resilience material at a frequency of 10 Hz and 23° C. is smaller than that of the first foamed body, and is typically 0.01 to 15 MPa, preferably 0.5 to 13 MPa, and more preferably 0.5 to 10 MPa. A low-resilience material obtained by foaming a formation material having such a storage elastic modulus Gω has a good flexibility. In principle, the lower limit value of the storage elastic modulus Gω is 0 (zero). In practice, however, the storage elastic modulus Gω exceeds 0. Formation materials that are actually commercially available have a storage elastic modulus Gω of 0.01 MPa or more, for example.

The storage elastic modulus Gω of an unfoamed formation material of the first foamed body at a frequency of 10 Hz and 23° C. is larger than that of the second foamed body, and is typically 20 MPa or more, preferably 30 to 300 MPa, and more preferably 40 to 200 MPa. A first foamed body obtained by foaming a formation material having such a storage elastic modulus Gω has a good resilience, stability, and cushioning property.

While there are no particular limitations on the expansion ratio of the low-resilience material, it is preferably 1.2 to 10, and more preferably, 1.5 to 7. The expansion ratio is obtained by dividing the unfoamed density by the foamed density.

In order to achieve a lighter weight, the specific gravity of the second foamed body (low-resilience material) is preferably 0.7 or less, more preferably 0.6 or less, and even more preferably 0.55 or less. The lower limit of the specific gravity of the second foamed body is preferably as low as possible. For example, the specific gravity of the second foamed body is preferably 0.1 or more, and more preferably 0.2 or more.

While there are no particular limitations on the expansion ratio of the first foamed body, it is preferably 1.2 to 200, and more preferably 10 to 100.

In order to achieve a lighter weight, the specific gravity of the first foamed body is preferably 0.6 or less, more preferably 0.5 or less, and even more preferably 0.4 or less. The lower limit of the specific gravity of the first foamed body is preferably as low as possible. For example, the specific gravity of the first foamed body is preferably 0.05 or more, and more preferably 0.15 or more.

The first and second foamed bodies have a thermoplastic resin component and any other arbitrary component. Examples of the thermoplastic resin component include, for example, a thermoplastic elastomer and a thermoplastic resin.

The type of the thermoplastic elastomer may be, for example, a styrene-based elastomer such as a styrene ethylene butylene styrene block copolymer (SEBS), an ethylene-vinyl acetate copolymer-based elastomer, etc.

The type of the thermoplastic resin may be, for example, a vinyl acetate-based resin such as an ethylene-vinyl acetate copolymer (EVA), polystyrene, a styrene butadiene resin, etc.

One of the resin components mentioned above may be used alone or two or more of them may be used in combination.

The outsole is a tread sole having a greater abrasion resistance than the mid sole, and typically has a higher hardness, and a higher recovering speed than the first foamed body of the mid sole. The outsole is typically formed by a foamed rubber material or a non-foamed rubber or urethane material.

In the present invention, the low-resilience second foamed body may be provided in the majority of one or more of the front foot portion, the middle foot portion and the rear foot portion. This is because the advantageous effects of layering are expected to be obtained unless it is used locally.

Note that "majority" means greater than or equal to one half of each planar area.

BRIEF DESCRIPTION OF DRAWINGS

FIGS. 5A and 5B are graphs showing the results of a cushioning test for Examples A-D and Normal Sample (comparative example), and FIG. 5C is a table showing the layered structure configurations of Test Examples A-D and Normal Sample.

FIGS. 6A and 6B are graphs showing the peak value and the peak angle upon 1st strike.

FIG. 9B is a table showing the evaluation results.

DESCRIPTION OF EMBODIMENTS

Figure 1A:
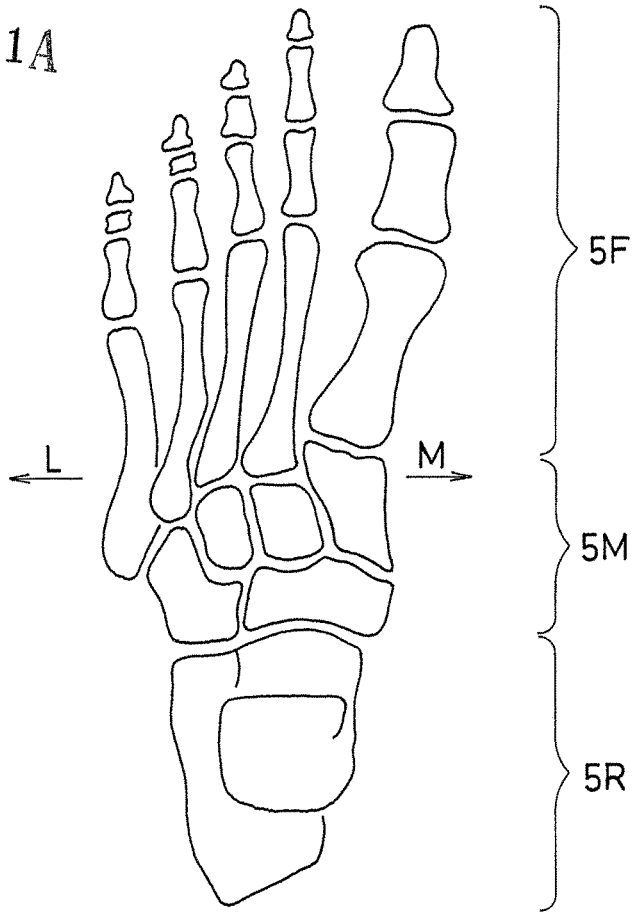
FIGS. 1A and 1B are a plan view and a medial side view, respectively, showing bones of the foot.

Preferably, the first and second foamed bodies and are each provided at least in the majority of the flat area of the rear foot portion;

in the rear foot portion, the layer of the second foamed body has a greater average thickness on a lateral side of a foot than on a medial side thereof; and in the rear foot portion, the layer of the first foamed body has a greater average thickness on a medial side of the foot than on the lateral side thereof.

More preferably, the first foamed body is arranged in the lower layer in the majority of the flat area of the rear foot portion, and the second foamed body is arranged in the upper layer in the majority of the flat area of the rear foot portion;

in the rear foot portion, the layer of the second foamed body in the upper layer has a greater average thickness on a lateral side of a foot than on a medial side thereof; and in the rear foot portion, the layer of the first foamed body in the lower layer has a greater average thickness on the medial side than on the lateral side.

When a shoe lands on the ground, a largest impact load acts upon the foot sole via the sole therebetween on the lateral side of the rear foot portion. This is referred to as the 1st strike, the impact can be absorbed as the 1st strike acts upon the low-resilience second foamed body.

Moreover, since the large load of the 1st strike acts over a short period of time, one can expect that, even if the hardness of the second foamed body is low, the deformation of the second foamed body, whose deformation is slow, is prevented from becoming too large, and that the stability for the support of the foot can be improved.

That is, in this case, the low-resilience material can be made thick in the rear foot portion on the lateral side, where the 1st strike is strong, whereas the low-resilience material can be made thin in the rear foot portion on the medial side, where the 1st strike is weak. Therefore, one can expect a high shock-absorbing property for the 1st strike and a high stability.

One can expect such advantageous effects as described above, whether the first foamed body or the second foamed body is arranged on top of the other.

Particularly, where the first foamed body that is relatively high hardness is arranged in the lower layer, a forward dynamic shear force to be acting upon the lateral side of the rear foot portion of the outsole upon 1st strike will be absorbed and dissipated by the first foamed body. Therefore, it is believed that the dynamic shear force to be acting upon the flexible second foamed body of the upper layer decreases, thereby improving not only the cushioning property but also the stability.

More preferably, a tapered portion in which a thickness of the second foamed body decreases as the second foamed body extends toward the medial side is provided between a lateral side portion in which the second foamed body is thick and which supports a lower surface of a foot sole on the lateral side in the rear foot portion, and a medial side portion in which the second foamed body is thin and which supports the lower surface of the foot sole on the medial side in the rear foot portion; and in a rear half portion of the rear foot portion, a rate of change in the thickness of the tapered portion is greater than a rate of change in the thickness of the lateral side portion, and the rate of change in the thickness of the tapered portion is greater than a rate of change in the thickness of the medial side portion.

Herein, it is deemed to fall within the present embodiment even if there are significant thickness variations due to local irregularities on the medial side or the lateral side, as long as the stability and cushioning property functions are not significantly detracted from. Since the lateral side portion and the medial side portion are for supporting the foot sole, they do not include roll-up portions at the medial and lateral edges.

If the thicknesses of materials of different mechanical properties change abruptly on the medial and lateral side of the foot, awkwardness is likely to be felt at the boundary portion.

In contrast, in the present embodiment, first and second foamed bodies having different mechanical properties from each other are layered on top of one another, and a tapered portion is provided whose thickness gradually changes from the medial side toward the lateral side. Therefore, it is possible to form a mid sole having different characteristics on the medial side and on the lateral side without feeling the awkwardness.

The two foamed bodies can be attached together on their surfaces not only over the tapered portion but also on the medial side and the lateral side, thereby improving the reliability of bonding or welding.

More preferably, on a cross section of at least a portion of the rear half portion of the rear foot portion, the tapered portion is arranged closer to the medial side than a center between the medial side and the lateral side.

In the rear half portion of the rear foot portion, the center of load of the 1st strike is located slightly toward the lateral side than the middle between the medial side and the lateral side. Therefore, the impact of the 1st strike is greater on the lateral side.

Therefore, with the tapered portion arranged off center toward the medial side, the impact of the 1st strike can be absorbed by the thick low-resilience material.

In another more preferred example, an average thickness of a middle portion which includes a center between the medial side and the lateral side of the upper layer of the second foamed body in the rear foot portion is greater than an average thickness of a medial side portion in which the second foamed body is thin and which supports a lower surface of a foot sole on the medial side in the rear foot portion.

In this case, the low-resilience material of the upper layer of the rear foot portion is thick not only on the lateral side of the foot but also in the middle portion between the medial side and the lateral side. Therefore, the impact of the 1st strike off center toward the lateral side can be absorbed by the thick low-resilience material.

In yet another preferred example, the first and second foamed bodies are each provided further in the middle foot portion; and an average thickness of the layer of the second foamed body in the middle foot portion is greater than a minimum thickness of the layer of the second foamed body in a medial side portion of the rear foot portion and is less than a maximum thickness of the second foamed body in a lateral side portion of the rear foot portion.

The height of the arch of the foot in the middle foot portion varies significantly from one individual to another. Therefore, as the layer of the second foamed body thicker than the medial side portion of the rear foot portion is provided in the middle foot portion, it is possible to prevent the user from feeling a pressure or an upthrust in the middle foot portion if the hardness of the low-resilience material is low.

Particularly, if the middle foot portion is thinner than the lateral side portion of the rear foot portion, it will serve to suppress over-pronation even if the hardness of the low-resilience material is low.

Preferably, the asker C hardness of the first foamed body is set to 50° to 65°; and the asker C hardness of the second foamed body Lc is set to 35.degree. to 60.degree. Thus, together with the above disclosure of: Preferably, the asker C hardness of the first foamed body Nc is set to 50.degree. to 65.degree., it is evident that when Lc is 60.degrees., then Lc=(Nc [of 50]+10). Likewise, it is evident that when the Lc is 35.degrees., then Lc=(Nc [of 50]−15). Therefore, the expression can be drawn: $Nc-15 \leq Lc \leq Nc+10$. Furthermore, when Lc is 35.degrees., then Lc=(Nc [of 55]−20). And, the expression can be drawn: $Nc-20 \leq Lc \leq Nc+10$.

If the hardness of the first foamed body is less than 50° in terms of the asker C hardness or the hardness of the second foamed body is less than 35° in terms of the asker C hardness, the deformation of the mid sole due to the load from walking or running will be excessive.

On the other hand, if the hardness of the first foamed body exceeds 65° in terms of the asker C hardness or the hardness of the second foamed body exceeds 60° in terms of the asker C hardness, the deformation will be too small, and the cushioning property decreases.

Figure 2A:
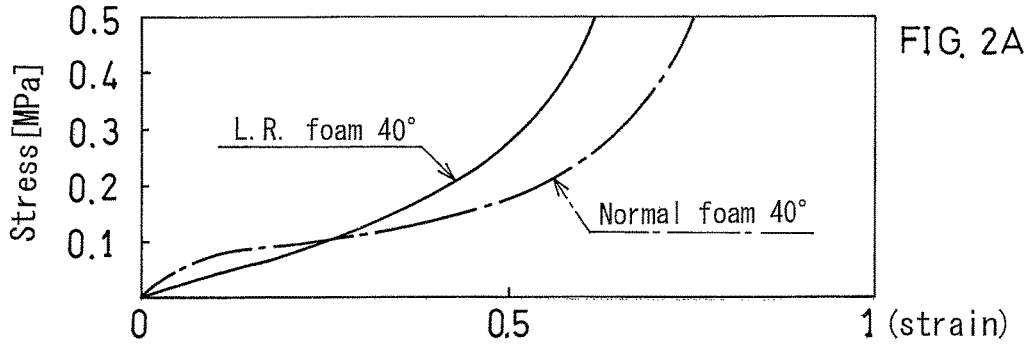
FIGS. 2A, 2B and 2C are each a compressive stress-strain curve of a foamed body or a layered foamed body.

FIG. 2A shows a stress-strain curve of a low-resilience material (L. R. foam: second foamed body) whose hardness is 40°, and that of a normal foam (first foamed body) used as a common mid sole material.

The low-resilience material indicated by a solid line in FIG. 2A has a higher linearity as compared with the first foamed body (Normal foam) indicated by a one-dot-chain line. Therefore, the low-resilience material does not undergo buckling with a low hardness or a high hardness, and does not abruptly significantly deform.

More preferably, a hardness of the first foamed body is set to 50° to 60° in terms of the asker C hardness; a hardness of the second foamed body is set to 40° to 50° in terms of the asker C hardness; and the hardness of the second foamed body is less than the hardness of the first foamed body.

The low-resilience second foamed body has a low speed of deformation. The second foamed body has a high linearity in the stress-strain curve as described above. Therefore, even with a relatively low hardness, it can be easily used in a portion of the mid sole. The low-hardness, low-resilience second foamed body serves to improve the cushioning property.

On the other hand, the first foamed body, having a higher hardness than that of the second foamed body, serves to prevent excessive deformation and to achieve a lighter weight.

More preferably, a value of the asker C hardness of the first foamed body is greater than a value of the asker C hardness of the second foamed body by 5° to 15°.

If the hardness difference between the foamed bodies is less than 5°, the range of hardness for practical use will be very limited, and it will be difficult in many cases to achieve expected properties.

On the other hand, if the hardness difference between the foamed bodies is greater than 15°, the difference between the stress-strain curves of the foamed bodies will be significant, and the deforming behavior under an applied load will likely be unstable.

In another preferred example, the hardnesses of the first and second foamed bodies are generally equal to each other, and are set to 50° to 55° in terms of the asker C hardness.

The range of hardness of 50° to 55° is easy to use for the mid sole, and as the hardnesses of the materials are generally equal to each other, the difference between the stress-strain curves of the foamed bodies will be small, whereby the deforming behavior is likely to be stable.

Herein, "the hardnesses being generally equal to each other" includes cases where the hardness difference between the foamed bodies is 2° or less. An error of about 2° will occur in the manufacturing process, and the hardness difference of such a degree will not detract from the advantageous effects described above.

In a mid sole in which a second foamed body of an upper layer in a rear foot portion is thicker on the lateral side than on the medial side, it is preferred that the hardness of the first foamed body is set to 50° to 65° in terms of the asker C hardness, and the hardness of the second foamed body is set to 35° to 50° in terms of the asker C hardness; and a value of the asker C hardness of the first foamed body is greater than a value of the asker C hardness of the second foamed body by 8° to 15°.

If the low-resilience first foamed body is arranged in the upper layer to be thicker on the lateral side and thinner on the medial side, with such a range of hardness and such a hardness difference as described below, the shock-absorbing property against the 1st strike and the stability will both improve as compared with a mid sole of a conventional normal foam (Normal foam).

In a mid sole in which a second foamed body of an upper layer in a rear foot portion is thicker on the lateral side than on the medial side, a hardness of the first foamed body is set to 53° to 57° in terms of the asker C hardness;

a hardness of the second foamed body is set to 43° to 57° in terms of the asker C hardness; and the hardness of the second foamed body is less than the hardness of the first foamed body or is generally equal to the hardness of the first foamed body.

Also in this case, the shock-absorbing property and the stability will both improve as compared with a mid sole of a conventional normal foam, as will be described below.

With the present mid sole, if the layers of the first and second foamed bodies are arranged at least in a majority of the rear foot portion, it is likely to achieve the stability and the shock-absorbing property described above.

In another preferred example, the second foamed body of the upper layer includes, as an integral member, a medial side portion for supporting a reverse surface on a medial side of a foot, a lateral side portion for supporting the reverse surface on a lateral side of the foot, and a medial roll-up portion for supporting a side surface on the medial side of the foot; and the medial roll-up portion has a thickness in a normal direction perpendicular to an upper surface of the first foamed body increasing as the medial roll-up portion extends from the medial side portion toward a medial edge.

The medial roll-up portion supports the medial side surface of the foot, and stabilizes the support of the foot against wobbling of the foot toward the medial side. Particularly, a low-resilience, thick medial roll-up portion has a low speed of deformation, and is more likely to prevent the foot from wobbling toward the medial side.

Where the low-resilience second foamed body has a low hardness, the second foamed body is more likely to get damaged than a normal first foamed body. Therefore, if the second foamed body is thin, the second foamed body deteriorates over use, and may undergo chapping and cracking. In view of this, the medial roll-up portion is thick in these embodiments, and it is possible to prevent the occurrence of chapping and cracking.

In yet another preferred example, the second foamed body of the upper layer includes, as an integral member, a medial side portion for supporting a reverse surface on a medial side of a foot, a lateral side portion for supporting the reverse surface on a lateral side of the foot, and a lateral roll-up portion for supporting a side surface on the lateral side of the foot; and the lateral roll-up portion has a thickness in a normal direction perpendicular to an upper surface of the first foamed body increasing as the lateral roll-up portion extends from the lateral side portion toward a lateral edge.

Similarly, the lateral roll-up portion supports the lateral side surface of the foot, and is likely to stabilize the support of the foot against wobbling of the foot toward the lateral side. Also, the lateral roll-up portion is thick, and can prevent the occurrence of chapping and cracking.

In yet another aspect, the present invention is a mid sole arranged on an outsole having a tread surface, wherein:

the mid sole has an upper layer and a lower layer;

in one of the upper layer and the lower layer, one or two or more of a majority of a flat area of a front foot portion, a majority of a flat area of a middle foot portion, and a majority of a flat area of a rear foot portion includes a layer of a first foamed body having a thermoplastic resin component;

in the other one of the upper layer and the lower layer, one or two or more of the majority of the flat area of the front foot portion, the majority of the flat area of the middle foot portion, and the majority of the flat area of the rear foot portion, in which the layer of the first foamed body is arranged, includes a layer of a second foamed body having a thermoplastic resin component;

the first foamed body and the second foamed body have different mechanical properties from each other;

in one of the three areas, a thickness of the first foamed body differs between a medial side and a lateral side of a foot, and in the area where the thickness of the first foamed body differs, a thickness of the second foamed body differs between a medial side portion and a lateral side portion supporting a reverse side of the foot;

a tapered portion whose thickness changes as the tapered portion extends from the medial side to the lateral side is provided between the medial side portion and the lateral side portion in the upper layer; and a rate of change in the thickness of the tapered portion is greater than a rate of change in the thickness of the medial side portion or a rate of change in the thickness of the lateral side portion.

As shown in FIG. 1A, a foot has significantly different structures on the medial side and on the lateral side.

For example, a rear foot 5R receives a significant 1st strike on the lateral side. While a midfoot 5M forms the arch of the foot, the height of the arch varies significantly from one individual to another. Upon toe-off, a front foot 5F significantly differently applies a force on the big toe and on the little toe.

Therefore, there are cases where the sole preferably employs materials having different mechanical properties on the medial side and on the lateral side.

However, when materials having different mechanical properties on the medial side and on the lateral side of the foot are placed against each other and attached together, awkwardness is likely to occur due to the material difference at the junction portion.

In contrast, in the present aspect, first and second foamed bodies having two mechanical properties are layered on top of one another, and a tapered portion is provided whose thickness gradually changes from the medial side toward the lateral side. Therefore, it is possible to form a mid sole having different characteristics on the medial side and on the lateral side without feeling the awkwardness.

The two foamed bodies can be attached together on their surfaces not only over the tapered portion but also on the medial side and the lateral side, thereby improving the reliability of bonding or welding.

In such an aspect, it is preferred that the layers of the first and second foamed bodies are arranged at least in the majority of the flat area of the rear foot portion;

in the rear foot portion, the layer of the second foamed body has a greater average thickness on the lateral side of the foot than on the medial side thereof;

in the rear foot portion, the layer of the first foamed body has a greater average thickness on the medial side of the foot than on the lateral side thereof; and the first foamed body has a greater asker C hardness than the second foamed body.

The center of load G of the 1st strike is located slightly toward the lateral side than the middle between the medial side and the lateral side. Therefore, the impact of the 1st strike is greater on the lateral side. Thus, the impact of the 1st strike can be absorbed by the lateral side portion of the second foamed body, which has a low hardness and is thick.

More preferably, on a cross section of at least a portion of a rear half portion of the rear foot portion, the tapered portion is arranged closer to the medial side than a center between the medial side and the lateral side.

As the tapered portion is arranged closer to the medial side than the center, there is an increased possibility of absorbing the impact of the 1st strike by the lateral side portion of the second foamed body, which has a low hardness and is thick.

Preferably, the layers of the first and second foamed bodies are arranged at least in the majority of the flat area of the middle foot portion;

in the middle foot portion, the layer of the second foamed body has a greater average thickness on the lateral side of the foot than on the medial side thereof;

in the middle foot portion, the layer of the first foamed body has a greater average thickness on the medial side of the foot than on the lateral side thereof; and the first foamed body has a greater asker C hardness than the second foamed body.

In this case, it is possible to suppress pronation.

Preferably, the second foamed body in the upper layer includes, as an integral member, the medial side portion for supporting a reverse surface on the medial side of the foot, the lateral side portion for supporting the reverse surface on the lateral side of the foot, and a medial roll-up portion for supporting a side surface on the medial side of the foot; and the medial roll-up portion has a thickness in a normal direction perpendicular to an upper surface of the second foamed body increasing as the medial roll-up portion extends from the medial side portion toward a medial edge.

In this case, the medial roll-up portion supports the medial side surface of the foot, and stabilizes the support of the foot.

Preferably, the second foamed body in the upper layer includes, as an integral member, the medial side portion for supporting a reverse surface on the medial side of the foot, the lateral side portion for supporting the reverse surface on the lateral side of the foot, and a lateral roll-up portion for supporting a side surface on the lateral side of the foot; and the lateral roll-up portion has a thickness in a normal direction perpendicular to an upper surface of the second foamed body increasing as the lateral roll-up portion extends from the lateral side portion toward a lateral edge.

In this case, the lateral roll-up portion supports the lateral side surface, and stabilizes the support of the foot.

The present invention will be more clearly understood from the description of the following preferred embodiments taken in conjunction with accompanying documents. Note however that the embodiments and the drawings are merely illustrative and should not be taken to define the scope of the present invention. The scope of the present invention shall be defined only by the appended claims. In the accompanying drawings, like reference numerals denote like components throughout the plurality of figures.

EMBODIMENTS

Embodiments of the present invention will now be described with reference to the drawings.

Figure 3A:
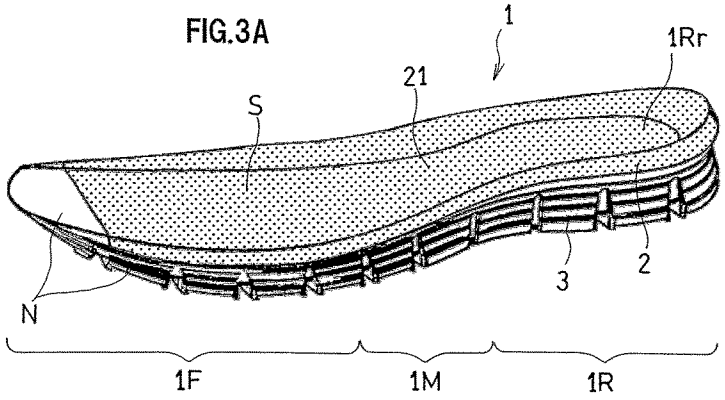
FIG. 3A is a schematic perspective view showing a mid sole according to an embodiment of the present invention.
Figure 3B:
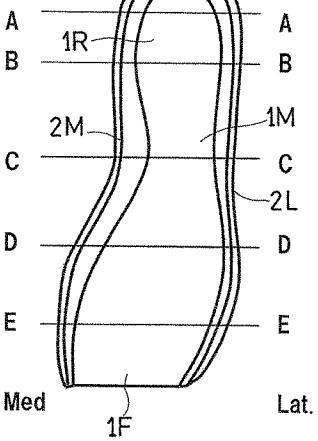
FIG. 3B is a plan view of a second foamed body.

A mid sole 1 shown in FIG. 3A is arranged on an outsole 4 as shown in FIGS. 4A to 4E. In FIGS. 3A, 4A to 4E, 9A, 12A to 12F and 13A to 13D, areas of the low-resilience material, i.e., the second foamed body S, are represented by halftone dots, and areas of the first foamed body N are hatched with thick lines and thin lines.

Note that the outsole 4 of FIGS. 4A to 4E includes a tread surface 4*s*.

In FIG. 3A, the mid sole 1 includes an upper layer 2 and a lower layer 3.

The lower layer 3 is made of a layer of the first foamed body N having a thermoplastic resin component. The upper layer 2 is made of a layer of the second foamed body S having a thermoplastic resin component.

In the upper layer 2, the second foamed body S is arranged to extend continuously over the majority of the flat area of a front foot portion 1F, the majority of the flat area of a middle foot portion 1M and the majority or the whole of the flat area of a rear foot portion 1R.

In the lower layer 3, the first foamed body N is arranged to extend continuously over the majority of the flat area of the front foot portion 1F, the majority of the flat area of the middle foot portion 1M and the majority or the whole of the flat area of the rear foot portion 1R.

The front foot portion 1F, the middle foot portion 1M and the rear foot portion 1R mean areas covering the front foot 5F, the midfoot 5M and the rear foot 5R, respectively, of the foot of FIG. 1A.

The front foot 5F consists of five metatarsal bones and fourteen phalangeal bones. The midfoot 5M consists of the navicular bone, the cuboid bone and three cuneiform bones. The rear foot 5R consists of the talus bone and the calcaneal bone.

The low-resilience material forming the second foamed body S has a higher viscosity and a smaller storage elastic modulus Gω than the first foamed body N. In the present invention, the low-resilience material is defined as a foamed body that has a higher specific gravity and has a lower speed of recovering its original shape after being deformed than the first foamed body N.

Figure 14A:
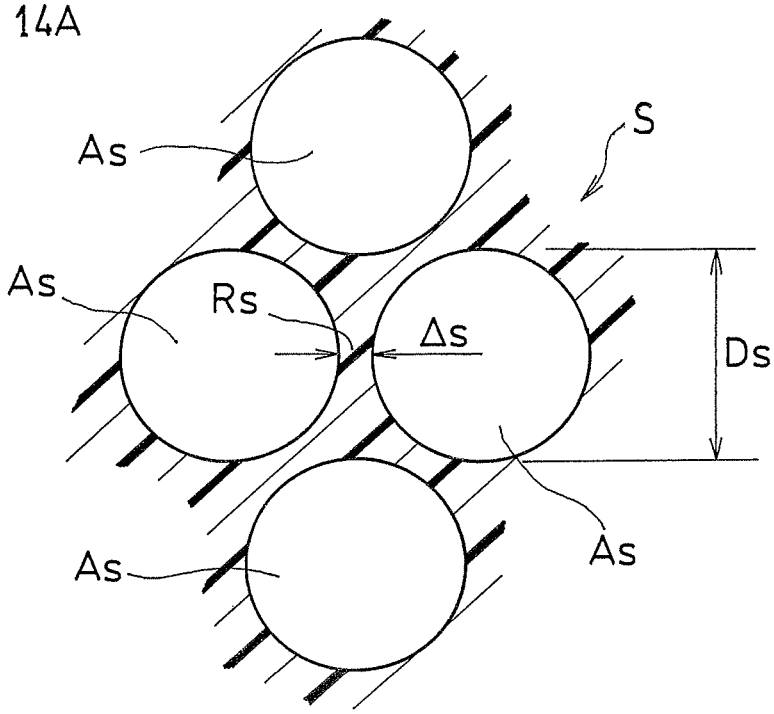
FIGS. 14A and 14B are schematic enlarged cross-sectional views showing, on an enlarged scale, the first and second foamed bodies, respectively.
Figure 14B:
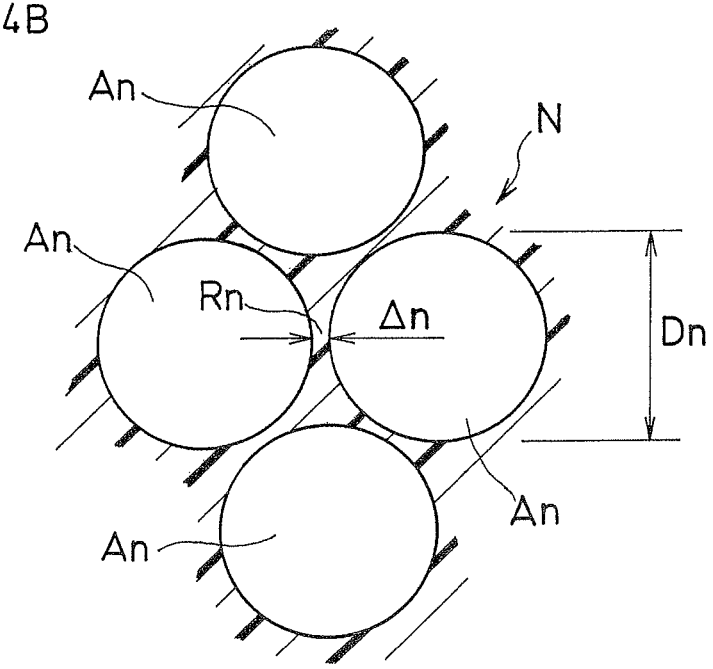

FIG. 14A shows an enlarged conceptual cross section of the second foamed body S, whereas FIG. 14B shows an enlarged conceptual cross section of the first foamed body N.

Referring to FIGS. 14A and 14B, the ratio of the bubble diameter Ds, Dn with respect to the distance Δs, Δn between bubbles As is larger for the first foamed body N than for the second foamed body S as represented by Expression (2) below.

$$Ds/\Delta s<Dn/\Delta n \quad (2)$$

That is, the value corresponding to the microscopic slenderness ratio R is larger for the first foamed body N than for the second foamed body S. Now, if the slenderness ratio R is greater than or equal to a certain level, a structure undergoes buckling even with a stress below the elastic limit. Therefore, the second foamed body S and the first foamed body N of the present invention can also be defined based on the diameter of bubbles As with respect to the distance between bubbles As as shown in Expression (2).

As shown in FIGS. 4A to 4E, the second foamed body S of the upper layer 2 includes, as an integral member, the medial roll-up portion 2M, the lateral roll-up portion 2L, a medial side portion SM, a lateral side portion SL and a middle portion SC. That is, the upper layer 2 is integrally continuous from the medial roll-up portion 2M to the lateral roll-up portion 2L.

In the medial side portion SM, the second foamed body S of the upper layer 2 supports the reverse surface of the medial side of the foot. The second foamed body S of the lateral side portion SL supports the reverse surface of the lateral side of the foot.

The medial roll-up portion 2M supports the side surface of the medial side M of the foot. As the medial roll-up portion 2M extends from the medial side portion SM toward the medial side M edge, the thickness of the medial roll-up portion 2M in the normal direction perpendicular to the upper surface of the first foamed body N increases.

The lateral roll-up portion 2L supports the side surface of the lateral side L of the foot. As the lateral roll-up portion 2L extends from the lateral side portion SL toward the lateral side L edge, the thickness of the lateral roll-up portion 2L in the normal direction perpendicular to the upper surface of the first foamed body N increases.

Figure 4A:
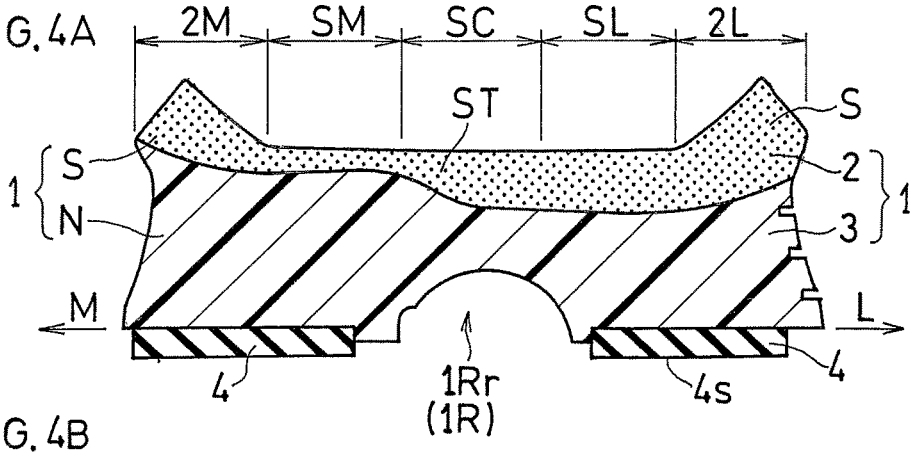
FIGS. 4A, 4B, 4C, 4D and 4E are cross-sectional views of the sole taken along line A-A, line B-B, line C-C, line D-D and line E-E, respectively, of FIG. 3B.
Figure 4B:
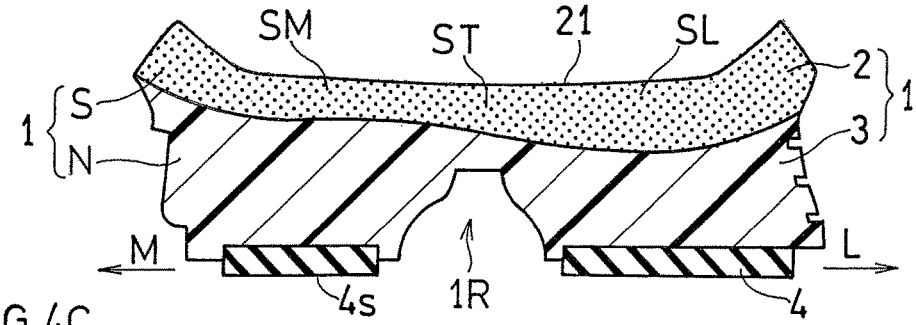

In the rear foot portion 1R of FIGS. 4A and 4B, the upper layer 2 formed by the second foamed body S has an average thickness on the lateral side L greater than the average thickness on the medial side M of the foot. On the other hand, in the rear foot portion 1R, the lower layer 3 formed by the first foamed body N has an average thickness on the medial side M greater than the average thickness on the lateral side L of the foot. Herein, the "average thickness on the medial side M" refers to the average thickness of a portion that is on the medial side of the medial/lateral center line of the foot, and the "average thickness on the lateral side L" refers to the average thickness of a portion that is on the lateral side of the medial/lateral center line of the foot. Note that in the present invention, the "average thickness" can be calculated by, for example, dividing the volume of a cut-out portion by the projected area from the upper surface, in addition to the method of directly measuring the cross section.

The middle portion SC includes the center between the medial side M and the lateral side L of the upper layer 2 of the second foamed body S, and is located between the medial side portion SM and the lateral side portion SL. In the rear foot portion 1R, the middle portion SC forms a tapered portion ST.

Over the tapered portion ST between the thick lateral side portion SL of the second foamed body S and the thin medial side portion SM of the second foamed body S, the thickness of the second foamed body S decreases as the second foamed body S extends toward the medial side M.

In the rear half portion 1Rr of the rear foot portion 1R of FIG. 4A, the rate of change in the thickness of the tapered portion ST is greater than the rate of change in the thickness of the lateral side portion SL, and the rate of change in the thickness of the tapered portion ST is greater than the rate of change in the thickness of the medial side portion SM.

In FIG. 4A, on a cross section of at least a portion of the rear half portion 1Rr of the rear foot portion 1R, the tapered portion ST is arranged closer to the medial side than the center between the medial side M and the lateral side L. Therefore, the thick portion of the second foamed body S extends toward the medial side rather than the center between the medial side M and the lateral side L.

As shown in FIGS. 4A and 4B, the average thickness of the middle portion SC including the tapered portion ST is greater than the average thickness of the thin medial side portion SM of the second foamed body S in the rear foot portion 1R. The average thickness of the middle portion SC is smaller than the average thickness of the thick lateral side portion SL of the second foamed body S in the rear foot portion 1R.

Figure 4C:
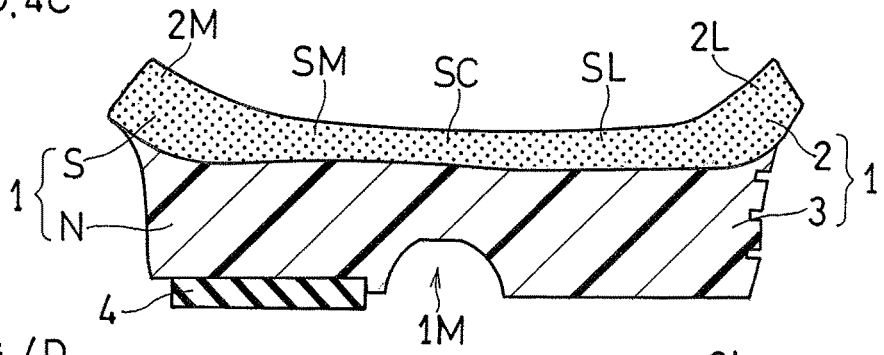

The average thickness of the layer of the second foamed body S in the middle foot portion 1M of FIG. 4C is greater than the minimum thickness of the layer of the second foamed body S of the medial side portion SM of the rear foot portion 1R of FIG. 4A and is less than the maximum thickness of the second foamed body S of the lateral side portion SL of the rear foot portion 1R.

Figure 4D:
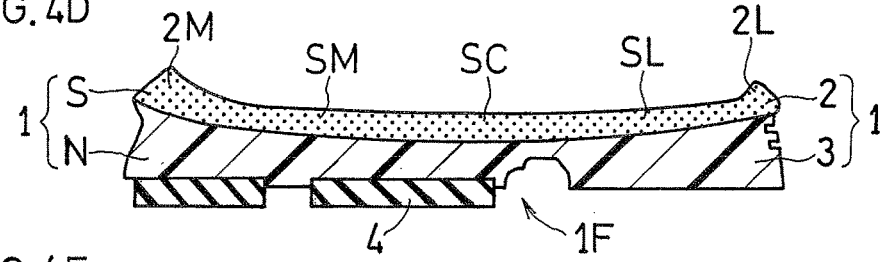
Figure 4E:
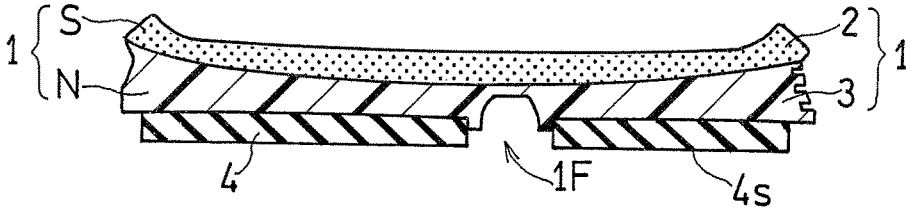

The average thickness of the second foamed body S is smaller in the middle foot portion 1M of FIG. 4C than in the rear foot portion 1R of FIGS. 4A and 4B, and is even smaller in the front foot portion 1F of FIGS. 4D and 4E than in the middle foot portion 1M.

On the other hand, the thickness ratio of the second foamed body S with respect to the mid sole 1 is larger in the front foot portion 1F of FIGS. 4D and 4E than in the rear foot portion 1R and the middle foot portion 1M of FIGS. 4A to 4C.

Such a thickness distribution of the second foamed body S increases the shock-absorbing property of the rear foot portion 1R.

Figure 1B:
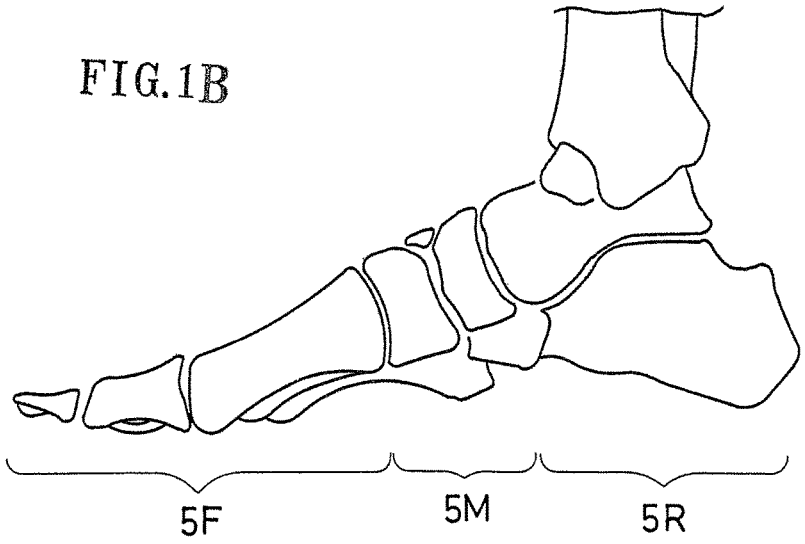

It will be possible to suppress the permanent deformation of the front foot portion 1F due to repeated and significant bending of the mid sole 1 upon push-off on the front foot 5F (FIG. 1). It also reduces the increase of weight of the mid sole 1 due to the second foamed body S having a high specific gravity.

The upper layer 2, the lower layer 3 and the outsole 4 are layered together by being bonded or welded together. For example, the upper layer 2 and the lower layer 3 may be bonded together as secondary molded products, or may be welded together during the secondary-molding of the primary molded products.

An insole (not shown) is bonded on the mid sole 1. Note that further on the insole, a sock liner (innersole) is placed in the upper.

Next, mechanical properties, functions and advantageous effects of the layered structure of the present invention will be described.

The one-dot-chain line of FIG. 2A represents a compressive stress-strain curve of a foamed body as a common mid sole material (hereinafter referred to as the "normal foam"). On the other hand, the solid line of the figure represents a compressive stress-strain curve of a low-resilience material (L. R. foam) used in the present invention. Note that their asker C hardnesses are both 40°.

As indicated by the one-dot-chain line of FIG. 2A, the normal foam exhibits such a linearity that the compressive stress and the strain are likely to be in proportion to each other in the initial stage of deformation. When the stress becomes about 0.1 MPa, however, the strain increases significantly for a slight increase in the compressive stress.

The reason for exhibiting such a phenomenon will be described below.

The normal foam N of FIG. 14B is such that the distance Δn between adjacent bubbles An with respect to the average diameter Dn of bubbles An, i.e., the value of the diameter Dn with respect to the thickness Δn of the microscopic resin structure Rn (Dn/Δn) is greater than that (Ds/Δs) of the low-resilience material S of FIG. 14A. Therefore, it is believed that although linearity is exhibited under a small load less than or equal to a predetermined load, buckling occurs in the resin structure Rn when a load greater than or equal to the predetermined load is applied. Thus, there is a stress area where the strain increases abruptly for a small load increase as shown in FIG. 2A. That is, the normal foam N has a low specific gravity and a high non-linearity. Therefore, in order to make the buckling less likely to occur, the normal foam N is preferably a foamed body having a relatively high hardness.

Note that the diameters Dn and Ds should each be an average value among a large number of bubbles An and As, and the distances Δn and Δs should each be an average value among shortest distances between adjacent bubbles.

On the other hand, the low-resilience material S having a high specific gravity of FIG. 14A is such that the distance Δs between bubbles As with respect to the diameter of bubbles As, i.e., the value of the average diameter Ds with respect to the minimum thickness Δs of the microscopic resin structure Rs (Ds/Δs), is smaller than that (Dn/Δn) of the normal foam. Therefore, the buckling is unlikely to occur, and when the load increases, the strain is likely to increase in proportion thereto. That is, the low-resilience material S has a high specific gravity and a high linearity. For example, in the case of an example of 40° of FIG. 2A (hereinafter the hardness designation "°" represents a value of asker C hardness), the low-resilience material exhibits a linearity up to an area of stress about as twice as that of the normal foam N, and the strain will not abruptly increase even if the compressive stress becomes greater than expected. Therefore, with the second foamed body, the intended cushioning property is likely to be obtained even with a foamed body of a relatively low hardness.

However, the low-resilience material has a high specific gravity. Therefore, if the mid sole is entirely formed by the low-resilience material, the sole will be too heavy. In view of this, the present inventors layered the normal foam and the low-resilience material together, thus arriving at a mid sole that is light in weight and is excellent in terms of the cushioning property, etc.

As for the mechanical properties of the layered structure, resultant value calculated by a computer simulation will now be described.

Note that a simple principle of superposition was used for the calculation.

Figure 2B:
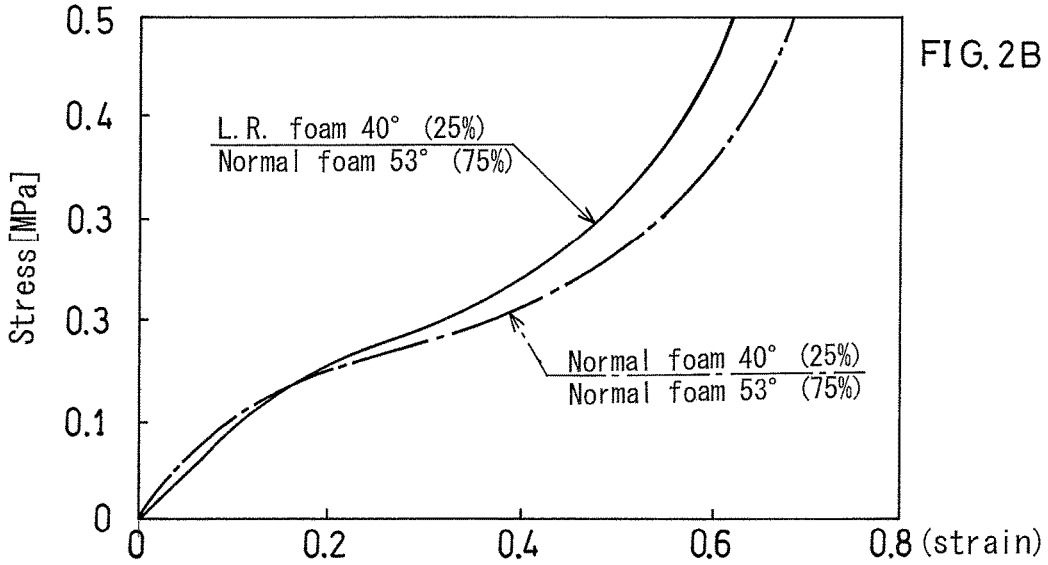
Figure 2C:
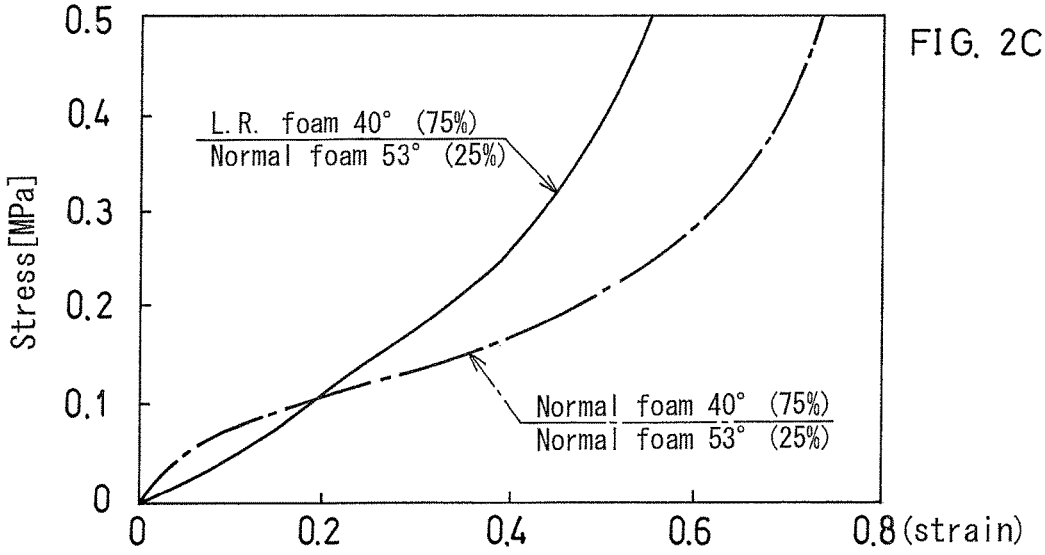

The one-dot-chain lines of FIGS. 2B and 2C each represent a compressive stress-strain curve of a layered structure in which normal foams of different hardnesses (40° and 53°) are layered together. On the other hand, the solid lines of FIGS. 2B and 2C each represent a compressive stress-strain curve of a layered structure in which a normal foam (53°) and a low-resilience material) (40° having different hardnesses are layered together.

The homogeneous layered structures obtained by combining normal foams together represented by one-dot-chain lines of FIGS. 2B and 2C each have a slightly improved compressive stress-strain linearity as compared with a single-hardness normal foam of FIG. 2A.

On the other hand, the heterogeneous layered structures obtained by combining a low-resilience material and a normal foam together represented by the solid lines of FIGS. 2B and 2C each have the linearity significantly improved as compared with the homogeneous layered structures. While the linearity is improved in the case where the thickness ratio between the low-resilience material and the normal foam is 25%:75% in FIG. 2B, the linearity is significantly improved in the case where the thickness ratio is 75%:25%, indicating that the linearity is kept up to a stress value of about 0.3 MPa and that the linearity is significantly improved as compared with the single low-resilience material.

Therefore, in areas where a large load is applied, it is estimated that the material is easy to use if the proportion of the thickness of the low-resilience material S with respect to the normal foam N is ⅓ or more and 3 times or less. For example, such areas include the front foot portion including the MP joint which is repeatedly significantly bent while walking and running, and the lateral side portion of the rear foot portion that receives a significant 1st strike.

Next, test examples and comparative example will be described in order to elucidate the advantageous effects of the present invention.

Five types of the mid sole 1 having structures of FIGS. 3A and 4A to 4E were provided.

FIG. 5C shows the asker C hardnesses of the normal foam (the first foamed body N) and the low-resilience material (the second foamed body S) of the five types of the mid sole 1. While Test Examples A-D of FIG. 5C are layered structures, "Normal" as comparative example is a single-layer structure of a normal foam such as a common mid sole.

Next, the test method will be briefly described.

A plurality of subjects (adults) successively wore the shoes each including one of the five types of the mid sole 1, and a vertical drop test was conducted while each subject wore an accelerometer on the lower leg, measuring the cushioning property of the front foot of FIG. 5A and the cushioning property of the rear foot of FIG. 5B by a known frequency analysis. Also, the amount of change β of the angle of the lower leg with respect to the foot in the inversion direction was measured, calculating the peak value of the 1st strike of FIG. 6A. Moreover, the amount of change γ of the angle of the lower leg with respect to the foot in the external rotation direction was measured in the same test, calculating the peak value. The evaluation values are shown in the figures.

As can be seen from FIGS. 5A to 5C, the mid soles of Test Examples A-D in which a low-resilience material of 35° to 45° and a normal foam of 55° to 65° are layered together have an improved cushioning property both in the front foot and in the rear foot, as compared with the normal foam sample (comparative example).

Figure 6A:
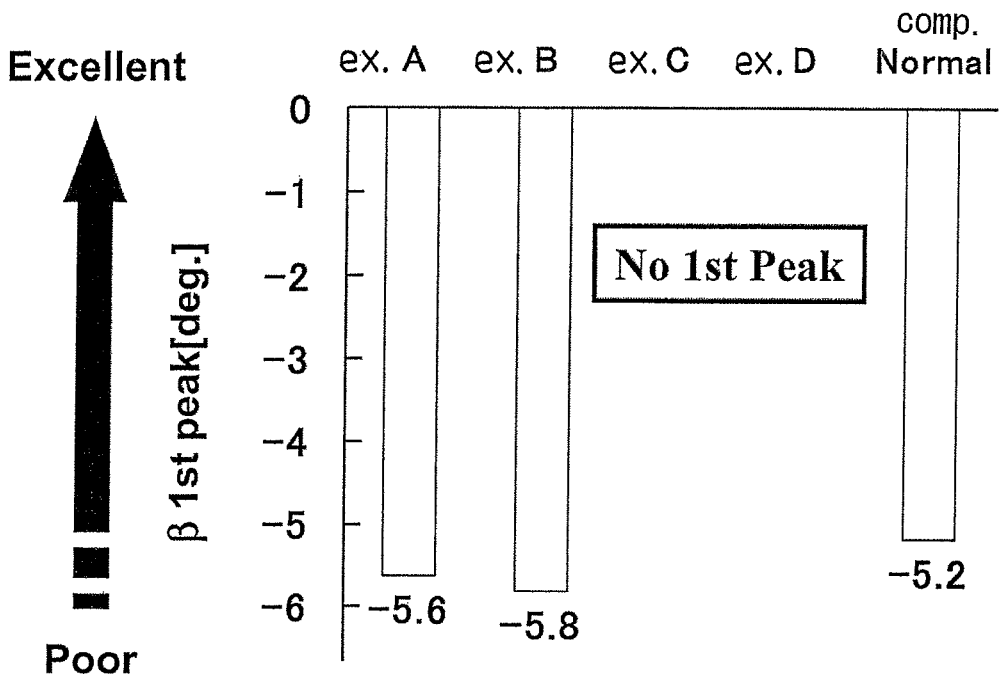
Figure 6A:
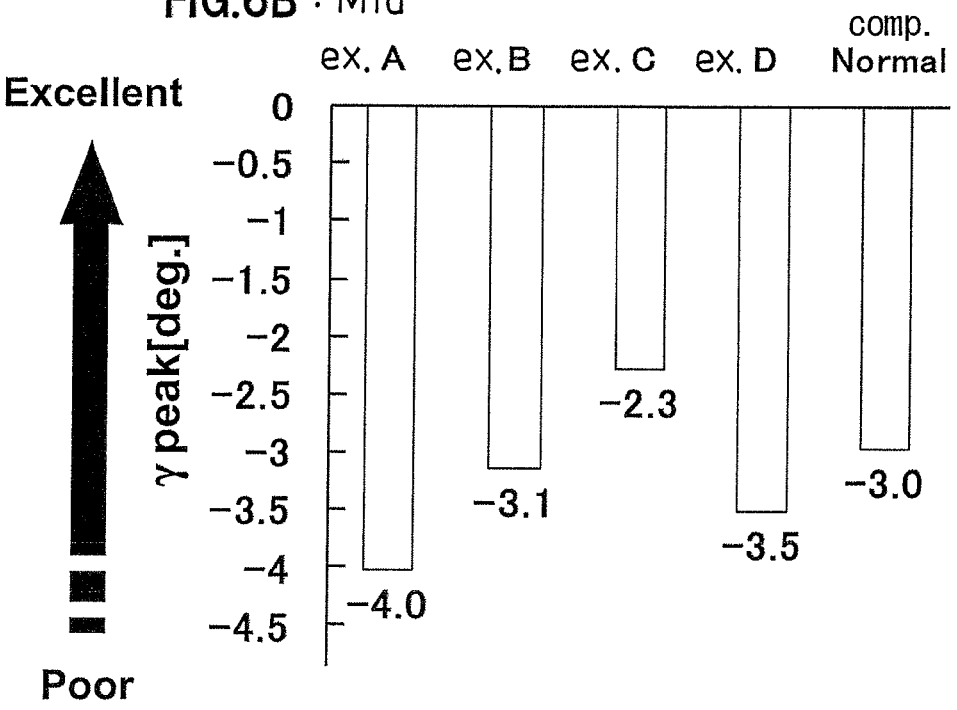

The value along the vertical axis of FIG. 6A represents the peak value of the amount of change β. When the amount of change β is small, the impact of the 1st strike to be acting upon the foot sole in the rear foot can be evaluated to be small.

As shown in FIG. 6A, the 1st peak of the amount of change β is not found in Test Examples C and D, and it is estimated that the impact of the 1st strike can be absorbed significantly. On the other hand, in Test Examples A and B, the peak value is greater than that of the normal foam comparative example.

The reason for this will now be discussed.

It is believed that in Test Examples C and D, a low-resilience material of which the asker C hardness is 45° is arranged in the upper layer 2 (FIG. 4A) in the rear foot portion 1R, and it will deform while keeping the linearity even if the compressive stress increases. Such deformation with linearity allows the low-resilience material S to exert its shock-absorbing function. It is estimated that for this reason, no clear 1st peak of the amount of change β was found in Test Examples C and D.

On the other hand, in Test Examples A and B, the low-resilience material S of which the asker C hardness is 35° is arranged in the upper layer 2 (FIG. 4A) in the rear foot portion 1R. As can be seen from FIG. 2A, the rate of deformation of the low-resilience material S decreases as the compressive stress increases. Therefore, it is estimated that if the hardness of the low-resilience material S is too small as compared with the load, the low-resilience material S is not allowed to exert its shock-absorbing function, resulting in a peak value of the amount of change β being greater than that of the normal foam comparative example.

In the present test, subjects were adults, and therefore a great load would be applied to the sole. When the shoe is worn by a child, a woman, or a middle-aged or elderly person, however, the load will be smaller. In such a case, even if the hardness of the low-resilience material S is 35°, one can sufficiently expect that the peak value of the 1st strike (amount of change β) will be small as compared with the normal foam comparative example.

Next, the stability evaluation will be described.

The value along the vertical axis of FIG. 6B represents the peak value of the amount of change γ. When the peak value of the amount of change γ is small, foot inversion or eversion is unlikely to occur, and one can evaluate the stability to be high.

The peak value of the amount of change γ for Test Example C of FIG. 6B is smaller than that of the normal foam comparative example. It is believed that the reason for this is that the low-resilience material S of the upper layer 2 has a delay in deformation, and therefore inversion or eversion is unlikely to occur. Therefore, it is believed that Test Example C is also excellent in terms of stability.

On the other hand, even though Test Example D of FIG. 6B uses a low-resilience material of 45°, as in Test Example C, the peak value of the amount of change γ thereof is larger than the normal foam comparative example. The reason for this will be discussed.

The normal foam of the lower layer 3 of Test Example C is 55°, which is commonly used, whereas Test Example D is harder at 65°. It is believed that the sole was therefore felt hard as a whole by the subjects, and the peak value of the amount of change γ was high. Therefore, it is estimated that if the wearer is a tall athlete with strong legs, the peak value of the amount of change γ is small and the stability can be high even with Test Example D.

Note however that it is believed that if the wearer is a tall athlete who is heavy, the peak value of the amount of change β upon 1st strike increases, and therefore if the hardness of the normal foam of the lower layer 3 is 65°, the hardness of the low-resilience material of the upper layer 2 is preferably also set to about 50° to 55°.

On the other hand, the peak value of the amount of change γ of Test Example B of FIG. 6B is slightly lower than Test Example D. It is estimated that this is because the hardness of the low-resilience material S of the upper layer 2 of Test Example B of FIG. 5C is smaller than Test Example D, and the rigidity of the mid sole as a whole decreases, and therefore the hardness of the sole as a whole comes closer to the normal foam comparative example.

The peak value of the amount of change γ of Test Example A of FIG. 6B is even higher than Test Examples B and D. It is believed that the reason for this is that the hardness of the lower layer 3 of Test Example A of FIG. 5C is 55°, which is commonly used and the hardness of the upper layer 2 is 35°, and the rigidity of the mid sole as a whole is too small for the subjects.

However, with a light-weighted wearer, such as a child, a woman, or a middle-aged or elderly person, the peak value of the amount of change γ is small, and the stability may improve. From the results of Test Example C and Test Example A, it is believed that the possibility of improving the stability can be increased by arranging a normal foam of about 55° in the lower layer 3, and a low-resilience material of 40° or more, or 41° or more and 45° or less, in the upper layer 2.

Next, a computer simulation conducted for the tapered portion ST of FIG. 4A will be described.

Figure 7A:
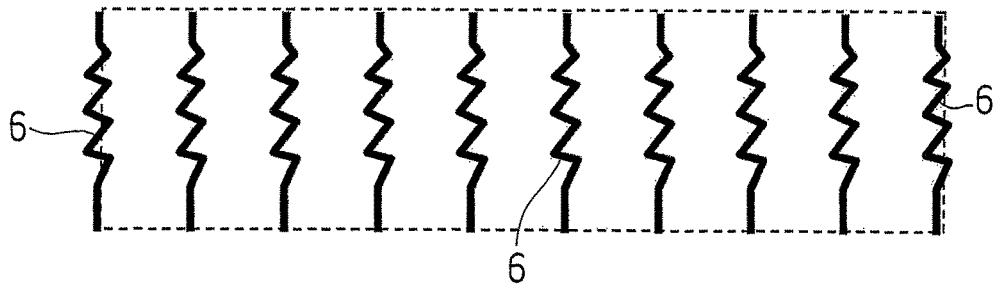
FIG. 7A is a conceptual diagram obtained by modeling the cross section of the mid sole.
Figure 7B:
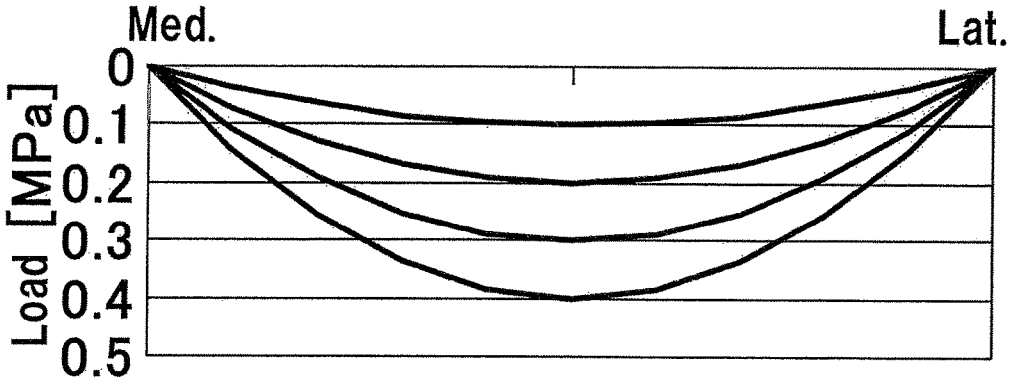
FIG. 7B is a graph showing a curve of the load to be acting on the mid sole.

In order to estimate the deformed state of the layered structure, the deformed state was calculated for the load distribution in which the medial side and the lateral side are equal to each other with the center portion being larger as shown in FIG. 7B. A load was applied to ten elastic elements 6 shown in FIG. 7A, and the deformed state was estimated by using calculated strain values.

Figure 8A:
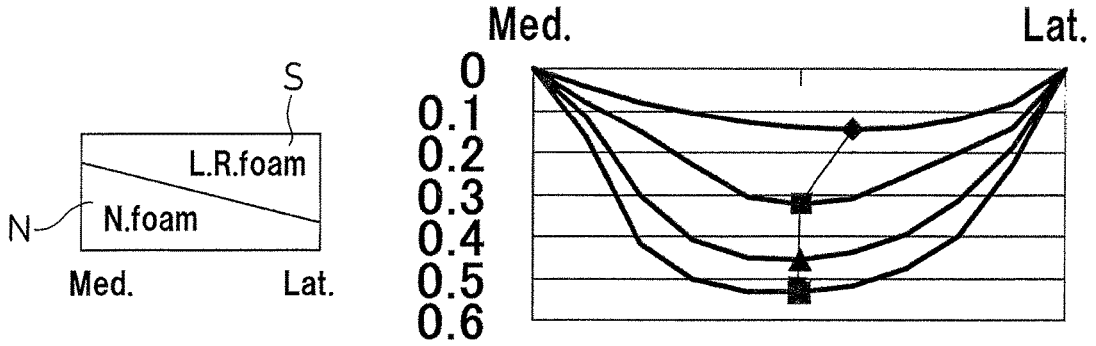
FIGS. 8A, 8B and 8C are diagrams and graphs showing the structure of the layered structure and the change of the compressive strain curve.
Figure 8B:
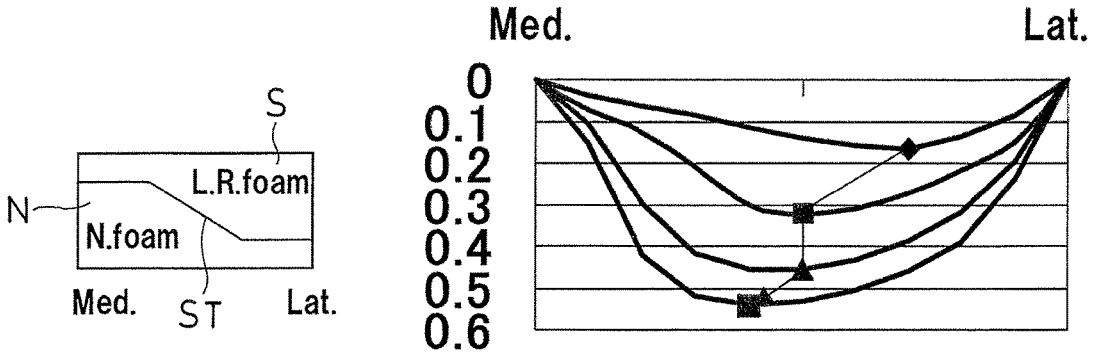
Figure 8C:
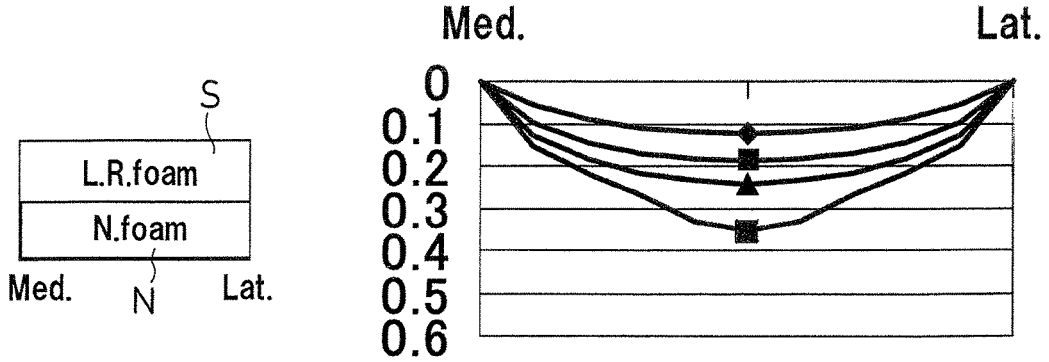

FIGS. 8A to 8C show deformed states for virtual layered structures different from one another in terms of the slope of the boundary surface. With a linear slope shown in FIG. 8A, the position of the maximum strain value has little medial-lateral deviation, whereas with a step-like tapered portion ST of FIG. 8B, the position of the maximum strain value has a significant medial-lateral deviation. With no slope as shown in FIG. 8C, the position of the maximum strain value does not change. Thus, it has been confirmed that when the low-resilience material S having the same hardness but with a lower initial rigidity and the high-hardness normal foam N are layered together as shown in FIGS. 8A and 8B, there are variations in characteristics, such as variations in the mode of deformation. Particularly, when the tapered portion ST of FIG. 8B is used in the width direction of the shoe, there is a significant deformation on the lateral side and the foot movement is not prevented, resulting in a comfortable feel on the foot, for lower loads, with the right side of the graph regarded as the lateral side Lat. On the other hand, it is estimated that when high loads are applied, the deformation on the medial side decreases, and there is little collapse of the heel, thereby realizing a high stability.

Next, a computer simulation conducted in the present invention for the hardness, the thickness and the presence/absence of a tapered portion for each foamed body will be described.

First, virtual layered structures 1V provided will be described.

Figures 9A, 9C:
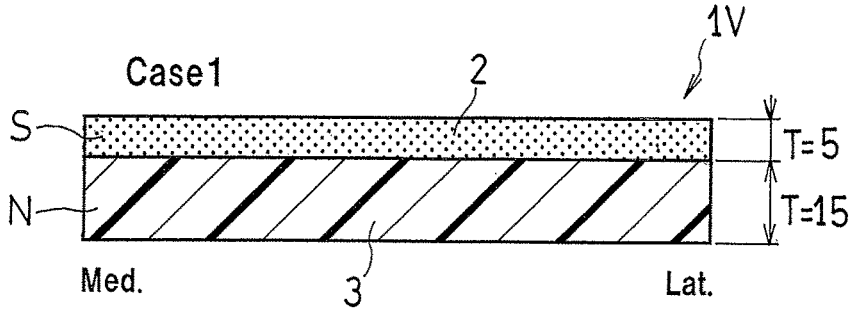
FIG. 9A is a cross-sectional view showing the structure of the layered structure of Case 1.
FIG. 9C is a table showing the evaluation criteria.

Case 1 of FIG. 9A, Cases 11-13 and Cases 21-23 of FIGS. 12A to 12F, and Cases 14, 15, 24 and 25 of FIGS. 13A to 13D were virtually provided as the layered structure 1V.

The thicknesses T (unit: mm) of the upper layer and the lower layer of these cases are as shown in FIG. 9A and FIGS. 10A to 10D.

Figure 11A:
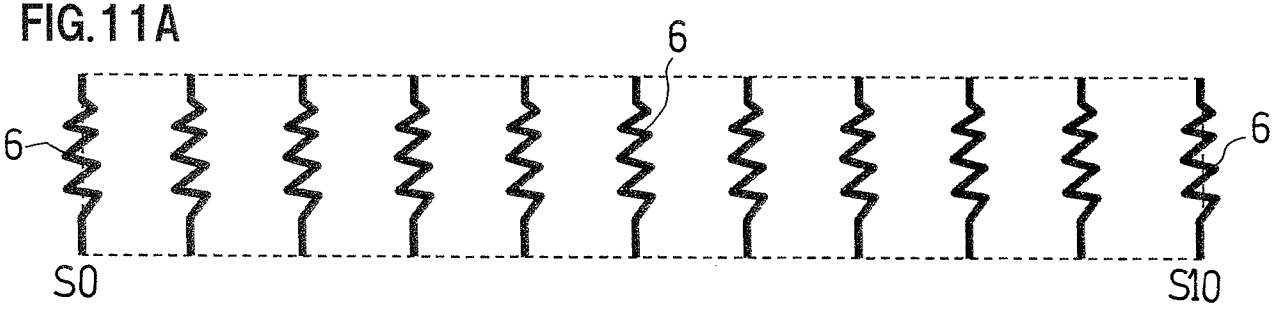
FIG. 11A is a conceptual diagram obtained by modeling the cross-sectional view of the mid sole.

Next, each layered structure 1V was replaced with a virtual model in which non-linear elastic elements 6 are arranged at positions corresponding to S0-S10 of FIG. 11A.

A virtual eccentric load, which is expected upon 1st strike, is applied to this virtual model, and the amount of deformation of the upper surface of each layered structure 1V was calculated based on the amounts of displacement of the elastic elements 6.

Figure 11B:
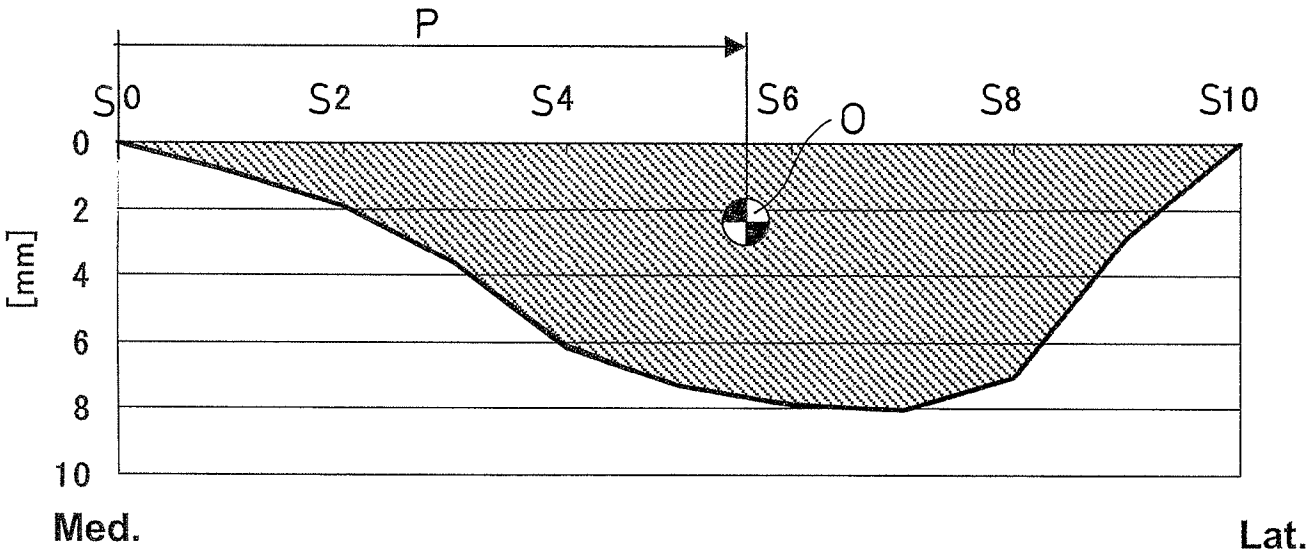
FIG. 11B is a conceptual diagram showing the amount of deformation of the mid sole upon 1st strike.

FIG. 11B shows the amount of deformation, and an example of the centroid (the center of the shape) O of the amount of deformation. Comparison was made against Test Example C, which scored a good evaluation in the evaluation of stability shown for an actual shoe of FIG. 6B, i.e., in the evaluation of stability using Actual Test Examples A-D, and the stability was evaluated to be higher when the position of the centroid O is smaller than Test Example C. The relationship between digital values of evaluation criteria and symbols is shown in FIG. 9C.

Each digital value of FIG. 9C indicates the distance P from S0 of FIG. 11B, and in FIG. 9C, a double circle denotes "best", a single circle "better", a triangle "same as conventional", and a cross "less than conventional".

Next, the mechanical properties and the shape of the foamed body of each case, and the evaluation results obtained for each case will be described.

With Case 1 of FIG. 9B and Cases 11-13 and 21-23 of FIGS. 12A to 12F, low-resilience materials S were virtually provided in steps of 5° from 35° to 60°, while normal foams N were virtually provided from 50° to 65°, as shown in the diagrams and tables.

In Case 1 of FIG. 9A, the low-resilience material S of the upper layer 2 is layered on the normal foam N of the lower layer 3. The thickness of the normal foam N of the lower layer 3 is set to 15 mm, and the thickness of the low-resilience material S of the upper layer 2 to 5 mm.

Figure 12A:
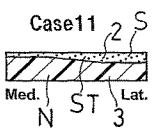
FIGS. 12A, 12B, 12C, 12D, 12E and 12F are diagrams and graphs showing the structure of the layered structure and evaluation results for Cases 11, 12, 13, 21, 22 and 23, respectively.
Figure 12B:
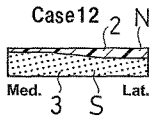
Figure 12C:
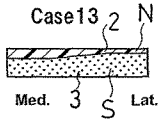
Figure 12D:
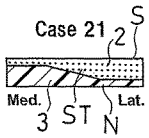

In Case 11 and Case 21 of FIGS. 12A and 12D, the low-resilience material S of the upper layer 2 is layered on the normal foam N of the lower layer 3. In these Cases 11 and 21, the tapered portion ST is provided in the middle portion of the upper layer 2.

From the results of Case 1 of FIG. 9B and Case 11 of FIG. 12A, one can expect that not only the cushioning property but also the stability will be improved if the hardnesses of the foamed body N and S in the mid sole 1 are generally equal to each other (hereinafter referred to "generally equal hardnesses") and are set to 50° to 55° in terms of the asker C hardness.

On the other hand, in Case 21 of FIG. 12D, a good stability cannot be expected if the hardnesses are equal to each other. It is estimated that the reason for this is that in Case 21, the thickness of the low-resilience material S of the upper layer 2 is large as shown in FIG. 10C. Therefore, it can be seen that where the hardnesses are 50° to 55° and are generally equal to each other, the thickness of the low-resilience material S of the upper layer 2 is preferably smaller than the normal foam N of the lower layer 3.

Figure 12E:
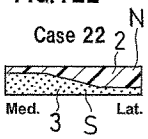

On the other hand, in Case 22 of FIG. 12E, the normal foam N of the upper layer 2 is layered on the low-resilience material S of the lower layer 3. In Case 22, also where the hardnesses are 50° to 55° and are generally equal to each other, one can expect that not only the cushioning property but also the stability will be improved.

In Case 12 of FIG. 12B, the thin normal foam N of the upper layer 2 is layered on the thick low-resilience material S of the lower layer 3. In Case 12, it can be seen that one can expect that not only the cushioning property but also the stability will be improved even if the hardness of the low-resilience material S is greater than the hardness of the normal foam N by 5° to 10°.

Also in Case 11 of FIG. 12A, it can be seen that one can expect improvements to the functionalities if the hardnesses are 55° and generally equal to each other.

Moreover, also in Case 11, it can be seen that one can expect improvements to the functionalities even if the hardness of the normal foam N is 55° and the hardness of the low-resilience material S is 60°, which is greater than 55° by 5°.

In Case 11 of FIG. 12A, it can be seen that one can expect improvements to the functionalities for a mid sole having a relationship as follows. That is, one can expect improvements to the functionalities if in the mid sole 1, the hardness of the normal foam N is set to 50° to 65° in terms of the asker C hardness;

the hardness of the low-resilience material S is set to 35° to 50° in terms of the asker C hardness; and the value of the asker C hardness of the normal foam N is greater than the value of the asker C hardness of the low-resilience material S by 10° to 15°.

Now, taking into consideration errors in measuring and manufacturing foamed bodies, one can expect functional improvements even if the hardness difference of 10° to 15° is 8° to 15°.

Thoroughly studying Case 11 of FIG. 12A, it can be seen that one can expect improvements to the functionalities if the hardness of the normal foam N is set to 55° in terms of the asker C hardness; and the hardness of the low-resilience material S is set to 45° to 55° in terms of the asker C hardness.

Moreover, taking into consideration errors in manufacturing foamed bodies, one can expect functional improvements even if in the mid sole 1 of Case 11, the hardness of the normal foam N is set to 53° to 57° in terms of the asker C hardness;

the hardness of the low-resilience material S is set to 43° to 57° in terms of the asker C hardness; and the hardness Lc of the low-resilience material S is smaller than the hardness Nc of normal foam N or generally equal to the hardness Nc of the normal foam N.

In Case 11 of FIG. 12A, i.e., where the low-resilience material S of the upper layer 2 is thicker on the lateral side Lat than on the medial side Med and the tapered portion ST is provided, improvements to the functionalities can be expected also under conditions as follows. That is, one can expect improvements to the functionalities also when in the mid sole 1, the hardness of the normal foam N is set to 50° to 65° in terms of the asker C hardness;

the hardness of the low-resilience material S is set to 35° to 50° in terms of the asker C hardness; and the value of the asker C hardness of the normal foam N is greater than the asker C hardness of the low-resilience material S by 5° to 15°.

Moreover, in view of the fact that the Test Example C of FIG. 5C gives the best results in the test using an actual shoe of FIG. 5A described above, one can expect even more significant improvements to the functionalities when in the mid sole 1, the hardness of the normal foam N is set to 50° to 60° in terms of the asker C hardness;

the hardness of the low-resilience material S is set to 40° to 50° in terms of the asker C hardness; and the value of the asker C hardness of the normal foam N is greater than the value of the asker C hardness of the low-resilience material S by 5° to 15°.

Next, why improvements to the functionalities can be expected even if the normal foam N and the low-resilience material S are arranged respectively in the upper layer 2 and the lower layer 3 will be discussed.

Figure 12F:
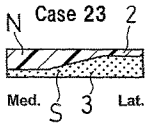
Figure 13A:
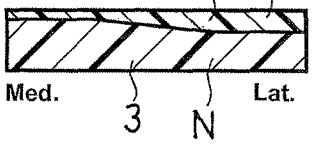
FIGS. 13A, 13B, 13C and 13D are diagrams and graphs showing the structure of the layered structure and evaluation results for Cases 14, 15, 24 and 25, respectively.
Figure 13B:
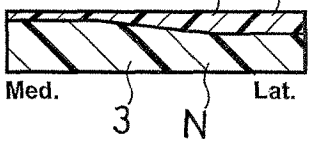
Figure 13C:
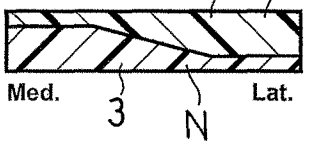
Figure 13D:
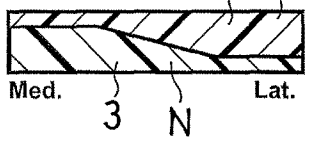

As can be seen from the evaluations in the diagrams and tables comparing between Case 21 of FIG. 12D and Case 23 of FIG. 12F, evaluations generally equal to each other were obtained for Case 23 of FIG. 12F in which the normal foam N was arranged in the upper layer 2 and the low-resilience material S was arranged in the lower layer 3 and for Case 21 of FIG. 12D, which is the reverse arrangement.

Note however that where the low-resilience material S is arranged in the lower layer 3 as in Case 23, the outsole 4 is arranged directly under the flexible low-resilience material S. Therefore, due to a delay in deformation of the low-resilience material S, it may not be suitable for rapid left-right movements.

Therefore, where the low-resilience material S is arranged in the lower layer 3, one can expect a good stability against left-right wobbling when the thickness of the low-resilience material S is smaller particularly in the front foot portion 1F.

As can be seen from Case 13 of FIG. 12C, good evaluations are not obtained when the low-resilience material S of the lower layer 3 is significantly thick across the medial side and the lateral side. Moreover, as can be seen from Case 12 of FIG. 12B, with a mid sole in which the low-resilience material S of the lower layer 3 is significantly thick across the medial side and the lateral side, good evaluations are obtained on the condition that the hardness of the low-resilience material S is greater than the normal foam N.

From these discussions, it is believed that where the low-resilience material S is arranged in the lower layer 3 of the rear foot portion, it is preferred that the thickness of the low-resilience material S at least in the medial side portion SM is smaller than the normal foam N.

Next, the thickness of the low-resilience material S will be discussed.

Figure 10A:
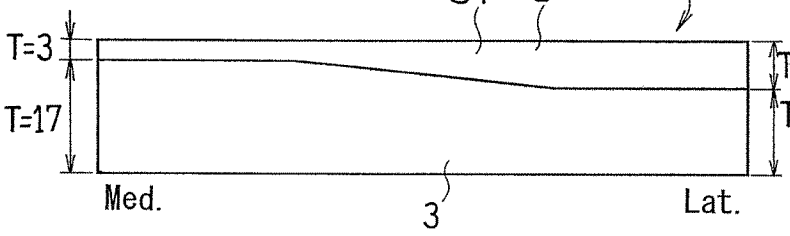
FIGS. 10A, 10B, 10C and 10D are conceptual diagrams showing the structures of the layered structures of Cases 11-15 and 21-25.
Figure 10B:
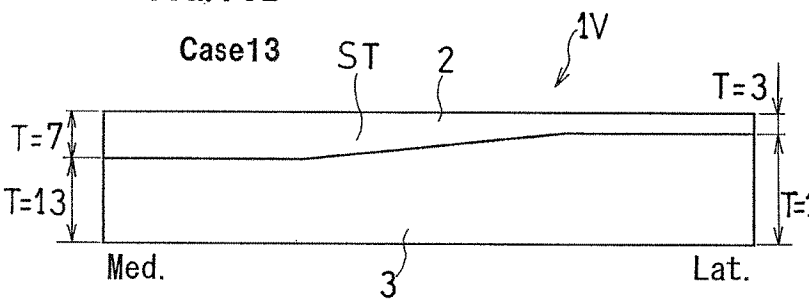
Figure 10C:
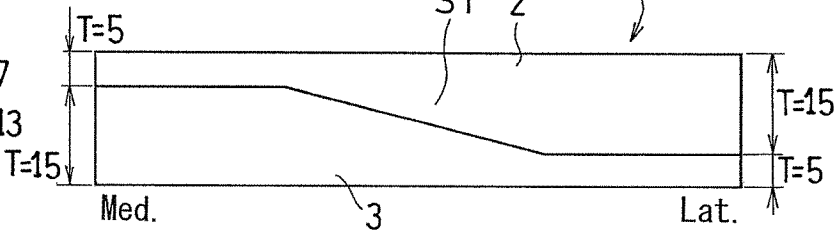
Figure 10D:
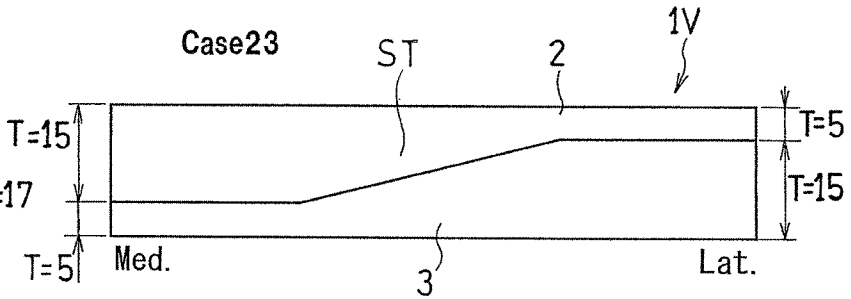

As in Case 12 of FIG. 12B and Case 13 of FIG. 12C, if the thickness of the low-resilience material S is 13 mm to 17 mm of FIGS. 10A and 10B, it will be difficult to employ a low-resilience material S having a low hardness.

On the other hand, as in Case 1 of FIG. 9A, Case 11 of FIG. 12A and Case 21 and Case 23 of FIGS. 12D and 12F, if the thickness of the low-resilience material S is 3 mm to 15 mm as in FIGS. 10A, 10B and 10C, one can use a low-resilience material S having a lower hardness than the hardness of the normal foam N.

From these results, it can be estimated that one can use a low-resilience material S that is thick in the lateral side portion of the rear foot portion and has a lower hardness than the hardness of the normal foam N.

In such a case, the preferred range of thickness is estimated to be from 5 mm of Case 1 of FIGS. 9A and 9B to about 15 mm of Case 21 of FIG. 12D.

However, even if it is thinner than 5 mm, as long as it is greater than or equal to 2 mm, which is manufacturable, some functional improvements can be expected even though the degree of functional improvements is smaller. Therefore, although there are no particular limitations on the thickness of the layer of the low-resilience material S in the present invention, it is believed that the thickness in the range of about 2 mm to 15 mm will be sufficient to be employed.

Next, reference will be made to Cases 14, 15, 24 and 25 of FIGS. 13A to 13D where the normal foams N are layered without the low-resilience material S included therein.

Substantially no good evaluations were obtained with these cases. However, the functionalities may possibly be improved, albeit slightly, where the hardness of the normal foam N of the upper layer 2 is lower than the hardness of the normal foam N of the lower layer 3, e.g., where the upper layer is 45° and the lower layer is 55° and 60°, as in Case 14 of FIG. 13A.

Next, the area where the low-resilience material S is arranged will be discussed.

From the results for the front foot of FIG. 5A, the rear foot of FIG. 5B and the midfoot of FIG. 6B, it can be seen that as long as this low-resilience material S is arranged in any one or more of the front foot portion 1F, the middle foot portion 1M and the rear foot portion 1R of FIG. 3A, one can expect improvements to the functionalities in the area or areas.

The low-resilience material S does not need to be provided entirely across each area 1F, 1M, 1R, but is only required to be provided over the majority of the flat area, i.e., over more than half of the flat area.

For example, with the rear foot portion 1R, the 1st strike shock-absorbing function will be exerted if it is provided at least over the rear half portion 1Rr, or if it is provided at least over the lateral side portion SL and the middle portion SC.

In the middle foot portion 1M, the low-resilience material S may be provided only in the medial side portion SM for preventing an upthrust, or conversely, the low-resilience material S having a lower hardness may be provided only in the lateral side portion SL for suppressing pronation.

For the front foot portion 1F, the low-resilience material S may be arranged in a majority portion at least including the area of the metatarsophalangeal joint (MP joint) which bends significantly, or in a majority portion including an area of the ball of the big toe exerting a significant push-off force.

The low-resilience material S may be arranged in two of the front foot portion 1F, the middle foot portion 1M and the rear foot portion 1R. For example, the low-resilience material S may be arranged at least in the front foot portion 1F and the middle foot portion 1M. The low-resilience material S may be arranged at least in the front foot portion 1F and the rear foot portion 1R. The low-resilience material S may be arranged at least in the middle foot portion 1M and the rear foot portion 1R.

While preferred embodiments have been described above with reference to the drawings, various obvious changes and modifications will readily occur to those skilled in the art upon reading the present specification.

For example, the hardness of the foamed body of the upper layer and/or the lower layer may differ between the medial side and the lateral side.

Shock-absorbing elements other than the foamed body, e.g., pods filled with a gel of the non-foamed material or air, may be included in the upper layer and/or the lower layer.

Grooves may be formed in the lower surface of the upper layer and/or the upper surface of the lower layer, and grooves extending in the up-down direction may be formed in the side surface of the mid sole.

Thus, such changes and modifications are deemed to fall within the scope of the present invention.

INDUSTRIAL APPLICABILITY

The present invention is applicable to mid soles on the bottom of shoes.

REFERENCE SIGNS LIST

1: Mid sole
1F: Front foot portion
1M: Middle foot portion
1R: Rear foot portion 1Rr: Rear half portion
2: Upper layer
21: Upper surface
2M: Medial roll-up portion
2L: Lateral roll-up portion
3: Lower layer
4: Outsole
4*s*: Tread surface
5F: Front foot
5M: Midfoot
5R: Rear foot
6: Elastic element
N: First foamed body (normal foam)
S: Second foamed body (low-resilience material)
SM: Medial side portion
SL: Lateral side portion
ST: Tapered portion
SC: Middle portion
M: Medial side of foot
L: Lateral side of foot
O: Centroid
β: Amount of change of angle in inversion direction
γ: Amount of change of angle in external rotation direction

The invention claimed is:

1. A mid sole arranged on an outsole having a tread surface, the mid sole comprising: an upper layer and a lower layer, each of the upper layer and the lower layer having a front foot portion, a middle foot portion, and a rear foot portion, wherein the upper layer includes a layer of a first foamed body having a thermoplastic resin component; and the lower layer includes a second foamed body having a thermoplastic resin component, each of the lower layer front foot portion, middle foot portion, and rear foot portion having a substantially flat area, wherein the second foamed body comprises at least one of (i) more than half of the flat area of the lower layer front foot portion, (ii) more than half of the flat area of the lower layer middle foot portion, and (iii) more than half of the flat area of the lower layer rear foot portion;

wherein the second foamed body is formed by a low-resilience material having (i) a weight per unit volume greater than a weight per unit volume of the first foamed body and having (ii) a speed of recovering to its original shape after being deformed lower than that of the first foamed body, and wherein a relationship between an asker C hardness Lc of the second foamed body and an asker C hardness Nc of the first foamed body is:

$$Nc-15 \leq Lc \leq Nc+10.$$

2. The mid sole according to claim 1, wherein, in the lower layer, the second foamed body is disposed only in one or both of (i) the front foot portion and (ii) the rear foot portion.

3. The mid sole according to claim 1, wherein, in one or both of (i) the front foot portion of the upper layer and the front foot portion of the lower layer and (ii) the rear foot portion of the upper layer and the rear foot portion of the lower layer, a thickness of the second foamed body is S, and a thickness of the first foamed body is N, and wherein:

$$(1/3) \times N \leq S \leq 3 \times N.$$

4. The mid sole according to claim 1, wherein:

each of the upper layer front foot portion, middle foot portion, and rear foot portion has a substantially flat area;

the first foamed body comprises more than half of the flat area of the upper layer rear foot portion;

the second foamed body comprises more than half of the flat area of the lower layer rear foot portion;

in the lower layer rear foot portion, the second foamed body has a greater average thickness on a lateral side of the mid sole than on a medial side thereof; and in the upper layer rear foot portion, the first foamed body has a greater average thickness on the medial side of the mid sole than on the lateral side thereof.

5. A mid sole arranged on an outsole having a tread surface, the mid sole comprising: an upper layer and a lower layer, each of the upper layer and the lower layer having a front foot portion, a middle foot portion, and a rear foot portion, wherein the lower layer includes a layer of a first foamed body having a thermoplastic resin component;

the upper layer includes a second foamed body having a thermoplastic resin component, each of the upper layer front foot portion, middle foot portion, and rear foot portion having a substantially flat area, wherein the second foamed body comprises at least one of; (i) more than half of the flat area of the upper layer front foot portion, (ii) more than half of the flat area of the upper layer middle foot portion, and (iii) more than half of the flat area of the upper layer rear foot portion;

wherein the second foamed body is formed by a low-resilience material having (i) a weight per unit volume greater than a weight per unit volume of the first foamed body and having (ii) a speed of recovering to its original shape after being deformed lower than that of the first foamed body, wherein a relationship between an asker C hardness Lc of the second foamed body and an asker C hardness Nc of the first foamed body is:

$$Nc-20 \leq Lc \leq Nc+10.$$

6. The mid sole according to claim 5, wherein:

each of the lower layer front foot portion, middle foot portion, and rear foot portion has a substantially flat area;

the first foamed body comprises more than half of the flat area of the lower layer rear foot portion;

the second foamed body comprises more than half of the flat area of the upper layer rear foot portion;

in the upper layer rear foot portion, the second foamed body has a greater average thickness on a lateral side of the mid sole than on a medial side thereof; and in the lower layer rear foot portion, the first foamed body has a greater average thickness on the medial side of the mid sole than on the lateral side.

7. The mid sole according to claim 6, wherein:

the hardness of the first foamed body is set to 50° to 65° in terms of the asker C hardness, and the hardness of the second foamed body is set to 35° to 50° in terms of the asker C hardness; and a value of the asker C hardness of the first foamed body is greater than a value of the asker C hardness of the second foamed body by 8° to 15°.

8. The mid sole according to claim 6, wherein:

a hardness of the first foamed body is set to 53° to 57° in terms of the asker C hardness;

a hardness of the second foamed body is set to 43° to 57° in terms of the asker C hardness; and the hardness of the second foamed body is less than the hardness of the first foamed body or is equal to the hardness of the first foamed body.

9. The mid sole according to claim 6, wherein:

the second foam body includes a tapered portion in which a thickness of the second foamed body decreases in a direction from the lateral side toward the medial side at least in the upper layer rear foot portion; and in a rear half portion of the upper layer rear foot portion, a thickness of the second foamed body at the tapered portion is non-linear.

10. The mid sole according to claim 9, wherein, in a lateral-to-medial cross section of at least a portion of the rear half portion of the upper layer rear foot portion, the tapered portion is disposed closer to (i) the medial side of the mid sole than iii) a midpoint between the medial side of the mid sole and the lateral side of the mid sole.

11. The mid sole according to claim 6, wherein the upper layer rear foot portion second foamed body has a middle portion which includes a midpoint between the medial side and the lateral side of the mid sole, and wherein said middle portion has an average thickness that is greater than an average thickness of a medial side portion of the upper layer rear foot portion second foamed body.

12. The mid sole according to claim 6, wherein:

the first and second foamed bodies are respectively disposed in the lower layer middle foot portion and in the upper layer middle foot portion; and the upper layer middle foot portion second foam body has an average thickness which (i) is greater than a minimum thickness of a medial side portion of the upper layer rear foot portion second foamed body, and (ii) is less than a maximum thickness of a lateral side portion of the upper layer rear foot portion second foamed body.

13. The mid sole according to claim 5, wherein:

the asker C hardness of the first foamed body is set to 50° to 65°; and the asker C hardness of the second foamed body is set to 35° to 60°.

14. The mid sole according to claim 13, wherein:

a hardness of the first foamed body is set to 50° to 60° in terms of the asker C hardness;

a hardness of the second foamed body is set to 40° to 50° in terms of the asker C hardness; and the hardness of the second foamed body is less than the hardness of the first foamed body.

15. The mid sole according to claim 13, wherein a value of the asker C hardness of the first foamed body is greater than a value of the asker C hardness of the second foamed body S by 5° to 15°.

16. The mid sole according to claim 5, wherein the hardnesses of the first and second foamed bodies and are equal to each other, and are set to 50° to 55° in terms of the asker C hardness.

17. The mid sole according to claim 5, wherein more than half of the upper layer rear foot portion comprises the second foamed body, and wherein more than half of the lower layer rear foot portion comprises the first foamed body.

18. The mid sole according to claim 5, wherein:

the second foamed body includes, as one integral member, (i) a medial side portion configured to support a medial side of a foot, (ii) a lateral side portion configured to support a lateral side of the foot, and (iii) a medial roll-up portion configured to support a side surface of the medial side of the foot; and the medial roll-up portion has a thickness that increases as the medial roll-up portion extends from the medial side portion toward a medial edge.

19. The mid sole according to claim 5, wherein:

the second foamed body includes, as one integral member, (i) a medial side portion configured to support a medial side of a foot, (ii) a lateral side portion configured to support a lateral side of the foot, and a (iii) lateral roll-up portion configured to support a side surface of the lateral side of the foot; and the lateral roll-up portion has a thickness that increases as the lateral roll-up portion extends from the lateral side portion toward a lateral edge.

20. A mid sole arranged on an outsole having a tread surface, wherein:

the mid sole has an upper layer and a lower layer, each of the upper layer and the lower layer having a front foot portion, a middle foot portion, and a rear foot portion, each of the upper layer front foot portion, middle foot portion, and rear foot portion having a substantially flat area, each of the lower layer front foot portion, middle foot portion, and rear foot portion having a substantially flat area;

one of the upper layer and the lower layer including a first foamed body having a thermoplastic resin component which is disposed in at least one of (i) more than half of the flat area of said one layer front foot portion, (ii) more than half of the flat area of said one layer middle foot portion, and (iii) more than half of the flat area of said one layer rear foot portion;

another one of the upper layer including a second foamed body having a thermoplastic resin component which is disposed in at least one of (i) more than half of the flat area of said another layer front foot portion, (ii) more than half of the flat area of said another layer middle foot portion, and (iii) more than half of the flat area of said another layer rear foot portion;

the first foamed body and the second foamed body have different mechanical properties from each other;

in one of the (i) upper layer front foot portion, (ii) upper layer middle foot portion, (iii) upper layer rear foot portion, (iv) lower layer front foot portion, (v) lower layer middle foot portion, and (vi) lower layer rear foot portion, a thickness of the first foamed body differs between a medial side and a lateral side of the mid sole, and in the area where the thickness of the first foamed body differs, a thickness of the second foamed body differs between a medial side portion and a lateral side portion of the mid sole;

the upper layer having a tapered portion whose thickness changes as it extends from the medial side to the lateral side of the mid sole; and a rate of change in the thickness of the tapered portion is greater than at least one of (i) a rate of change in thickness of an upper layer medial side portion, and (ii) a rate of change in thickness of an upper layer lateral side portion.

21. The mid sole according to claim 20, wherein:

both of the first and second foamed bodies and are disposed in respective layers in more than half of the substantially flat areas of said one layer rear foot portion and said another layer rear foot portion, respectively;

in said another layer rear foot portion, the layer of the second foamed body has a greater average thickness on the lateral side of the mid sole than on the medial side thereof;

in said one layer rear foot portion, the layer of the first foamed body has a greater average thickness on the medial side of the mid sole than on the lateral side thereof; and the first foamed body has a greater asker C hardness than the second foamed body S.

22. The mid sole according to claim 20, wherein:

both of the first and second foamed bodies and are disposed in respective layers in more than half of the substantially flat areas of said one layer middle foot portion and said another layer middle foot portion, respectively;

in said another layer middle foot portion, the layer of the second foamed body has a greater average thickness on the lateral side of the mid sole than on the medial side thereof;

in said one layer middle foot portion, the layer of the first foamed body has a greater average thickness on the medial side of the mid sole than on the lateral side thereof; and the first foamed body has a greater asker C hardness than the second foamed body.

23. The mid sole according to claim 5, wherein, in the upper layer, the second foamed body is disposed only in one or both of (i) the front foot portion and (ii) the rear foot portion.

24. The mid sole according to claim 5, wherein, in one or both of (i) the front foot portion of the upper layer and the front foot portion of the lower layer and (ii) the rear foot portion of the upper layer and the rear foot portion of the lower layer, a thickness of the second foamed body is S, and a thickness of the first foamed body is N, and wherein:

$$(1/3)\times N \leq S \leq 3\times N.$$

* * * * *